US007893005B2

(12) United States Patent
Funada et al.

(10) Patent No.: US 7,893,005 B2
(45) Date of Patent: Feb. 22, 2011

(54) RECEPTOR LAYER TRANSFER MATERIAL, TRANSFER SHEET, AND COLORING MATERIAL RECEPTOR SHEET WITH RELIEF LAYER, AND IMAGE FORMING METHOD USING THE SAME

(75) Inventors: Hiroshi Funada, Tokyo (JP); Kazuya Yoshida, Tokyo (JP); Hirofumi Tomita, Tokyo (JP); Makoto Aoyagi, Tokyo (JP); Tetsuya Matsuyama, Tokyo (JP)

(73) Assignee: Dai Nippon Printing Co., Ltd., Tokyo-to (JP)

( * ) Notice: Subject to any disclaimer, the term of this patent is extended or adjusted under 35 U.S.C. 154(b) by 1005 days.

(21) Appl. No.: 11/547,956

(22) PCT Filed: Apr. 6, 2005

(86) PCT No.: PCT/JP2005/006791

§ 371 (c)(1),
(2), (4) Date: Jan. 24, 2007

(87) PCT Pub. No.: WO2005/097515

PCT Pub. Date: Oct. 20, 2005

(65) Prior Publication Data

US 2008/0009412 A1 Jan. 10, 2008

(30) Foreign Application Priority Data

| | | |
|---|---|---|
| Apr. 6, 2004 | (JP) | 2004-111773 |
| Jul. 27, 2004 | (JP) | 2004-218150 |
| Jan. 17, 2005 | (JP) | 2005-008639 |

(51) Int. Cl.
*B41M 5/035* (2006.01)
*B41M 5/50* (2006.01)

(52) U.S. Cl. ..... 503/227; 428/32.39

(58) Field of Classification Search ..... None
See application file for complete search history.

(56) References Cited

U.S. PATENT DOCUMENTS

| | | | |
|---|---|---|---|
| 5,344,808 | A | 9/1994 | Watanabe et al. |
| 6,489,266 | B1 | 12/2002 | Kurokawa et al. |

FOREIGN PATENT DOCUMENTS

| | | |
|---|---|---|
| JP | 60-034898 | 2/1985 |
| JP | 61-283595 | 12/1986 |
| JP | 2-203375 | 8/1990 |
| JP | 2-204092 | 8/1990 |

(Continued)

OTHER PUBLICATIONS

European Search Report: PCT/JP2005006791.

*Primary Examiner*—Bruce H Hess
(74) *Attorney, Agent, or Firm*—Ladas & Parry LLP

(57) ABSTRACT

A receiving layer transfer material which represents a free combination of a hologram and an image of various colors by an on-demand printing system such as thermal transfer method, onto a transfer layer which is transferred onto an object. The receiving layer transfer material is provided with a release layer 3, a relief forming layer 5 having a reflection layer 6 at a relief forming side and having a visual effect, and an adhesive layer 7, which are sequentially stacked on one surface of a substrate 2.

6 Claims, 6 Drawing Sheets

FOREIGN PATENT DOCUMENTS

| | | |
|---|---|---|
| JP | 2-212193 | 8/1990 |
| JP | 4-221693 | 8/1992 |
| JP | 6-83258 | 3/1994 |
| JP | 6-83259 | 3/1994 |
| JP | 7-186515 | 7/1995 |
| JP | 7-314925 | 12/1995 |
| JP | 8-39945 | 2/1996 |
| JP | 11-5373 | 1/1999 |
| JP | 11-042863 | 2/1999 |
| JP | 11-254844 | 9/1999 |
| JP | 11-263075 | 9/1999 |
| JP | 2000-218908 | 8/2000 |
| JP | 2001-30668 | 2/2001 |
| JP | 2001-191653 | 7/2001 |
| JP | 2003-054132 | 2/2003 |
| JP | 2003-094840 | 4/2003 |
| JP | 2004-114546 | 4/2004 |

RECEPTOR LAYER TRANSFER MATERIAL, TRANSFER SHEET, AND COLORING MATERIAL RECEPTOR SHEET WITH RELIEF LAYER, AND IMAGE FORMING METHOD USING THE SAME

BACKGROUND OF THE INVENTION

1. Field of the Invention

The present invention relates to a receiving layer transfer material, more specifically to the receiving layer transfer material capable of forming an image provided with both a visual effect due to a relief forming layer and an image represented by colorant, as well as an image forming method and an image-formed object using such a transfer material.

Particularly, the present invention relates to the receiving layer transfer material provided with a special decorative image and/or stereoscopic image having a relief structure such as hologram or diffraction grating, as well as a thermal transfer image, on the object, using a thermal transfer recording system. The present invention further relates to the image forming method and the image-formed object using such a transfer material.

Furthermore, the present invention relates to the receiving layer transfer material and transfer sheet capable of obtaining a highly designable image provided with a thermal transfer image and white diffusion light or white reflection light into a specific angle range from the relief forming layer, by printing and forming the thermal transfer image by a thermal transfer printing system, onto a dye receiving layer on the relief forming layer having a white reflection function. The present invention further relates to the image forming method and the image-formed object using such a transfer material or sheet.

2. Description of the Related Art

Conventionally, a transfer foil having a relief structure such as hologram or diffraction grating can represent a special decorative image or stereoscopic image. And, the hologram or diffraction grating requires a sophisticated technology for producing the same and difficult to produce. Thereby, the hologram or diffraction grating is used for a security purpose such as forgery prevention. For example, they are used in cards such as credit card, ID card or prepaid card. They are also used in cash vouchers such as gift voucher, check, bill, stock (share) certificate or entrance ticket, since they cannot be reproduced on a color copier. Also, they have a use to be transferred onto various ID photos of driver's license, passport or the like. Furthermore, because of their specific designability, they are often used in wrapping paper, book, pamphlet, POP and so on.

In order to apply such a relief structure as hologram or diffraction grating onto an object, a transfer method using a transfer foil is known. The transfer foil is provided with a release layer, a relief forming layer having a pattern such as hologram or diffraction grating, a reflection layer, and an adhesive layer, which are sequentially stacked (layered) on a substrate. In order to transfer and print the transfer foil, a hot stamping or thermal transfer with hot roll is typically known. In the thermal transfer, a transfer foil is disposed between a heated metal stamp or roll and an object, and the transfer foil is compressed onto the object by the stamp or roll, and then the substrate is removed.

Recently, a technology for combining the relief forming layer such as hologram or diffraction grating and printed image (thermal transfer image) by a thermal transfer printer is required, in order to improve designability and the security purpose.

Therefore, in the receiving layer transfer material and the transfer sheet, there is a need for a full-colored feature, a good visibility regardless of an observation point, a good color reproducibility even in the case of observation at an observation point within a wide range, a natural image without losing color balance, an easiness to be produced, and an easiness of transferring a thermal transfer image onto the relief forming layer. On the other hand, in the image forming method and image-formed object using such a receiving layer transfer material and the transfer sheet, it is required to obtain a highly designable full color image.

Conventionally, a technology is disclosed in which a hologram transfer layer is disposed on a printed image (e.g. Japanese Patent Application Laid-open No. H6-83258). However, the hologram is attached on the printed image only to protect the image. It is not possible to dispose a printed image on the hologram.

Another technology is disclosed in which a hologram transfer foil is provided with a dye receiving layer, so that a printed image is formed onto the dye receiving layer by a thermal transfer printed and then transferred onto the object (e.g. Japanese Patent Application Laid-open Nos. H6-83259, H7-186515, H7-314925, H8-39945, H11-42863 and 2001-191653). However, since the printed image with dye is formed before the hologram transfer, there is a defect that the printed image cannot be formed after the hologram transfer. Furthermore, after the transfer layer including the hologram is transferred onto the object, the release layer is exposed on the surface of the transfer layer. Therefore, it is difficult to form the thermal transfer image on the transfer layer, since it is difficult to transfer and fix the colorant and thereby difficult to form the printed image, especially in the case of printing with a thermal transfer printer using a sublimation type thermal transfer sheet having a dye layer containing a sublimation dye.

These transfer foils may be of transparent reflection type. However, if it has an opaque type metallic reflection layer, the underlying image cannot be viewed at a part where the hologram is transferred.

Furthermore, a technology is disclosed in which a hologram transfer layer is provided with a colorant layer therein, so that a metallic color hologram is transferred onto an object (e.g. Japanese Patent Application Laid-open No. 2000-218908). However, there is a defect that the transferred color is limited to a color of the colorant layer, and thereby an image cannot be represented with various colors.

Furthermore, there is disclosed a highly designable image obtained by forming an image of dots each having a fine area onto an object by a thermal head, with a use of a thermal transfer sheet using three kinds of OVD (Optical Variable Device) each having a spatial frequency for rendering an observed color will be one of three primary colors RGB, in a specific observation point, as an image display medium for viewing a true full color image without any chromatic aberration, provided with OVD such as hologram or diffraction grating (e.g. Japanese Patent Application Laid-open No. H11-5373). However, since a full color image is reproduced only at a specific observation point, the color balance is lost and the reproduced color is deteriorated, even with slightly deviation of the observation point. Particularly, a human face seems extremely pale or red from another observation point, which gives a very unnatural impression. Thus, the greatest defect of the conventional technologies is in a fact that a direction of an observer is limited to one direction in order to view a full color image, and a true color is not reproduced when observed from any other directions.

Furthermore, the second defect is a fact that black cannot be reproduced properly, unless the underlying color of print is black, which gives a limitation of the underlying color. In order to represent black in the conventional art, a case that a diffraction light of OVD is zero, i.e. a case that dots each having fine area are not printed by the thermal head, is defined as "black", whereas white color is represented by equalizing a total amount of fine dots among each three colors RGB.

Therefore, if the underlying color of the object is white when printing, for example if a person wearing black hairs is printed in a conventional art, the black hair portion is not printed. Thereby, white color of the underlying color is viewed, which gives an unnatural impression as if the person wears white hairs. Thus, in the conventional art, the color of the object where an image is formed has a limitation, and a true full color image cannot be displayed.

SUMMARY OF THE INVENTION

In any of the above patent documents, there is no description or suggestion about an expectation that hologram and image of various colors can be freely combined and represented on-demand, by easily printing an image with a thermal transfer printer, if a sublimation type thermal transfer sheet is used, onto a transfer layer which is transferred onto an object.

In view of this, the present invention has been accomplished in order to solve above problems. The first object of the present invention is to provide a receiving layer transfer material capable of representing a free combination of hologram and image of various colors, by an on-demand printing system such as thermal transfer, onto a transfer layer which is transferred onto an object. This object includes also providing an image forming method and an image-formed object, using the transfer material.

The second object of the present invention is to provide a receiving layer transfer material and a transfer sheet capable of easily obtaining a highly designable full color image which has a good visibility regardless of an observation point, and a color reproducibility even with an observation at an observation point in a wide range, and which is natural without losing a color balance. This object includes also providing an image forming method and an image-formed object, using the transfer material or sheet.

The above object is achieved by the present invention which is a receiving layer transfer material comprising a release layer, a colorant receiving layer, a relief forming layer having a reflection layer at a relief forming side and having a visual effect, and an adhesive layer, which are sequentially disposed on one surface of a substrate.

It is possible to obtain a highly designable image provided with both the visual effect due to the relief forming layer and the image represented by colorant, by transferring the transfer layer including the relief forming layer and the colorant receiving layer onto the object from the receiving layer transfer material, and the image is formed by colorant onto the transfer layer.

In an embodiment of the receiving layer transfer material according to the present invention, if the relief forming layer has a hologram image, it is possible to obtain a highly designable image provided with both the hologram image and the image represented by colorant.

In an embodiment of the receiving layer transfer material according to the present invention, if the relief forming layer has a relief pattern having a white diffusion function or a white reflection function within a specific angle range, it is possible to obtain a highly designable image provided with both white light from the relief layer and the thermal transfer image.

In the receiving layer transfer material mentioned above, the colorant receiving layer may comprise a thermoplastic resin and a release agent. Thereby, the colorant receiving layer surely receives and fixes the dye which constitutes the thermal transfer image, so that the receiving layer transfer material is presented which can provide the thermal transfer image having a good shelf life.

In the receiving layer transfer material mentioned above, an anchor layer may be disposed between the colorant receiving layer and the relief forming layer. Thereby, there is presented the receiving layer transfer material which has a good adhesiveness between each layers of the transfer layer, and which prevents the peeling between each layers during transfer, and which has a good shelf life after transfer.

According to the present invention, there is provided a transfer sheet comprising a set of: a region in which a release layer, a colorant receiving layer, a relief forming layer having a reflection layer at a relief forming side and having a visual effect, and an adhesive layer are sequentially stacked; and a region in which a colorant layer of at least one color is disposed, wherein the set is repeatedly disposed at least once on one surface of a substrate.

Since this transfer sheet has the transfer layer including the colorant receiving layer and the relief forming layer, and the colorant layer, which are disposed side by side on one substrate, there is presented the transfer sheet capable of easily obtaining a highly designable color image by printing the thermal transfer image onto the dye receiving layer of the transfer layer, successively after transferring the transfer layer including the dye receiving layer.

The transfer sheet according to the present invention mentioned above may comprises a set of four regions including: a region in which a release layer, a colorant receiving layer, a relief forming layer having a reflection layer at a relief forming side and having a visual effect, and an adhesive layer are sequentially stacked; a region of a yellow colorant layer; a region of a magenta colorant layer; and a region of a cyan colorant layer, wherein the set is repeatedly disposed at least once on one surface of a substrate.

According to this arrangement, it is possible to obtain a highly designable full color image of subtractive color mixture type by printing the thermal transfer image onto the colorant receiving layer of the transfer layer, successively after transferring the transfer layer including the colorant receiving layer.

The transfer sheet according to the present invention mentioned above may comprise a set of four regions including: a region in which a release layer, a colorant receiving layer, a relief forming layer having a reflection layer at a relief forming side and having a visual effect, and an adhesive layer are sequentially stacked; a region of a red colorant layer; a region of a green colorant layer; and a region of a blue colorant layer, wherein the set is repeatedly disposed at least once on one surface of a substrate.

According to this arrangement, there is presented the transfer sheet capable of easily obtaining a highly designable full color image of additive color mixture type, by printing the thermal transfer image onto the colorant receiving layer of the transfer layer, successively after transferring the transfer layer including the colorant receiving layer.

The transfer sheet according to the present invention mentioned above may further comprises a region of a black colorant layer in addition to the four regions so as to comprise a set of five regions, wherein the set of the five regions is repeatedly disposed at least once on one surface of a substrate. Thereby, it is possible to print black color by providing the black colorant layer in addition to RGB, although the black color cannot be printed only by RGB.

Also, according to the present invention, there is provided a colorant receiving sheet with a relief layer, comprising: a substrate; a relief forming layer having a reflection layer at a relief forming side and having a visual effect, formed on one surface of the substrate; a colorant receiving layer, formed at a more surface side than the relief forming layer or at a side of the substrate opposite to the side of the substrate having the relief forming layer.

By using this colorant receiving sheet having the relief layer, it is possible to obtain a highly designable image provided with both the visual effect due to the relief forming layer and the image represented by the colorant, as in the case of the receiving layer transfer material and the transfer sheet.

In an embodiment of the colorant receiving sheet with the relief layer, it may comprise at least; a reflection layer; a relief forming layer; and a colorant receiving layer, which are sequentially stacked on one surface of the substrate.

In the colorant receiving sheet with the relief layer mentioned above, it is especially preferable to have the relief forming layer which has a relief pattern having a white diffusion function or a white reflection function within a specific angle range.

In the case that the relief forming layer having a white diffusion function or a white reflection function are transferred from the transfer sheet to the object, a pattern of the reflector is likely to be collapsed because of a heat during transfer. In view of this, it is preferable to form the relief having a white diffusion function or a white reflection function onto the object in a way other than transfer.

Also, according to the present invention, there is presented an image forming method using the receiving layer transfer material mentioned above, the method comprising steps of: transferring onto an object a transfer layer in which an adhesive layer, a relief forming layer having a reflection layer at a relief forming side and having a visual effect, and a colorant receiving layer are sequentially stacked; forming an image comprising a colorant by an on-demand printing onto the colorant receiving layer of the object onto which the transfer layer is transferred, to form an image comprising both the visual effect due to the relief forming layer and the thermal transfer image.

According to this image forming method, it is possible to print the image represented by the colorant in a free combination with the visual effect due to the relief structure, by applying the receiving layer transfer material according to the present invention to an on-demand printing system.

Also, according to the present invention, there is provided the image forming method, using the receiving layer transfer material mentioned above, the method comprising steps of: transferring onto an object a transfer layer in which an adhesive layer, a relief forming layer having a reflection layer at a relief forming side and having a visual effect, and a colorant receiving layer are sequentially stacked; forming an image comprising a colorant onto the colorant receiving layer of the transfer layer, by using the object onto which the transfer layer is transferred and the transfer sheet having the colorant layer, to form an image comprising both the visual effect due to the relief forming layer and the thermal transfer image.

In the image forming method according to the present invention mentioned above, it is possible to use the receiving layer transfer material, and the transfer sheet comprising a set of four regions including: a region of a yellow colorant layer, a region of a magenta colorant layer and a region of a cyan colorant layer, the set being repeatedly disposed at least once on one surface of the substrate.

According to this, it is possible to obtain a highly designable full color image of subtractive color mixture type, by printing the thermal transfer image onto the colorant receiving layer of the transfer layer, successively after transferring the transfer layer including the colorant receiving layer.

Also, in the image forming method according to the present invention mentioned above, it is possible to use the receiving layer transfer material, and the transfer sheet comprising a set of four regions including: a region of a red colorant layer, a region of a green colorant layer and a region of a blue colorant layer, the set being repeatedly disposed at least once on one surface of the substrate, so that the thermal transfer image is formed in such a manner that dots of each color are not overlapped.

According to this, it is possible to obtain a highly designable full color image of additive color mixture type, by printing the thermal transfer image onto the colorant receiving layer of the transfer layer, successively after transferring the transfer layer including the colorant receiving layer.

In the image forming method according to the present invention mentioned above, it is possible to use the transfer sheet further comprising a region of a black colorant layer in addition to the four regions so as to comprise a set of five regions, the set being repeatedly disposed at least once on one surface of the substrate.

Also, according to the present invention, there is provided an image forming method using a transfer sheet according to the present invention mentioned above, the method comprising steps of: onto an object, transferring a transfer layer in which an adhesive layer, a relief forming layer having a reflection layer at a relief forming side and having a visual effect, and a colorant receiving layer are sequentially stacked; and forming a thermal transfer image comprising a colorant, to form an image comprising both the visual effect due to the relief forming layer and the thermal transfer image.

According to this, it is possible to transfer the transfer layer including the relief forming layer and the colorant receiving layer, and the image represented by the colorant, from one thermal transfer sheet to the object.

In the image forming method according to the present invention mentioned above, it is possible to use the transfer sheet provided with a set of four regions at least including: a region of the transfer layer, a region of a yellow colorant layer, a region of a magenta colorant layer and a region of a cyan colorant layer, wherein the set is repeatedly disposed at least once on one surface of the substrate.

According to this, it is possible to transfer three primary colors, YMC, as well as the transfer layer including the relief forming layer and the colorant receiving layer, from one thermal transfer sheet to the object.

In the image forming method according to the present invention mentioned above, it is possible to use the transfer sheet provided with a set of four regions at least including: a region of the transfer layer, a region of a red colorant layer, a region of a green colorant layer and a region of a blue colorant layer, wherein the set is repeatedly disposed at least once on one surface of the substrate, so that the thermal transfer image is formed in such a manner that dots of each color are not overlapped.

According to this, it is possible to transfer three primary colors, RGB, as well as the transfer layer including the relief forming layer and the colorant receiving layer, from one thermal transfer sheet to the object.

In the image forming method according to the present invention mentioned above, it is possible to use the transfer sheet further provided with a region of a black colorant layer in addition to the four regions so as to comprise a set of five regions, the set being repeatedly disposed at least once on one surface of the substrate.

According to this, it is possible to transfer three primary colors, RGB, as well as the transfer layer including the relief forming layer and the colorant receiving layer, from one thermal transfer sheet to the object, and print black color which cannot be printed only by RGB.

Also, according to the present invention, there is provided an image forming method comprising a step of forming an image comprising a colorant by an on-demand printing, onto the colorant receiving sheet with the relief layer mentioned above, so that the method forms an image comprising both a visual effect due to a relief forming layer and the image comprising the colorant.

According to this method, it is possible to obtain a highly designable image provided with both the visual effect due to the relief forming layer and the image represented by the colorant, as in the case of the method using the receiving layer transfer material and the transfer sheet.

Also, according to the present invention, there is provided an image-formed object formed by the image forming method according to the present invention mentioned above, wherein the object is provided with the image both comprising the visual effect due to the relief forming layer and the thermal transfer image.

EFFECT OF THE INVENTION

According to the present invention, it is possible to present a very specific decorative effect by freely combing the visual effect due to the relief structure with the image represented by the colorant, by using the on-demand printing system. Also, since the image obtained on the object has a layered structure in which the image represented by the colorant covers the relief structure for exerting the visual effect, it is possible to obtain the image having the improved security such as forgery prevention effect.

Particularly, in the case that the relief forming layer has the hologram image, it is possible to print the image in a freely combination with the hologram image with various colors, so that a very highly designable image can be obtained.

Also, in the case that the relief forming layer has the relief pattern having a white diffusion function or a white reflection function within a specific angle range, the obtained image has a good visibility regardless of the observation point, and has good color reproducibility even with an observation at the observation point in a wide range. Furthermore, the black color is properly reproduced, even if the underlying color of print is not black. The image is natural without losing color balance. Thus, a highly designable full color image can be obtained.

Particularly, by using as background the relief forming layer having the white diffusion function or the white reflection function within a specific angle range, and printing the dots image in such a manner that dots of each color of RGB are not overlapped, white light passes through the thermal transfer image and the dots image based on the color information acts as if it were a color filter relative to the white light, so that a bright highly designable color or full color image can be easily obtained. Furthermore, even if the underlying color changes, the image-formed object having good color reproducibility was presented.

Furthermore, by using the black colorant layer in addition to the RGB, it is possible to reproduce the black color which cannot be reproduced only by the RGB. Thereby, the color reproducibility and the color balance are further improved.

Figure 1:
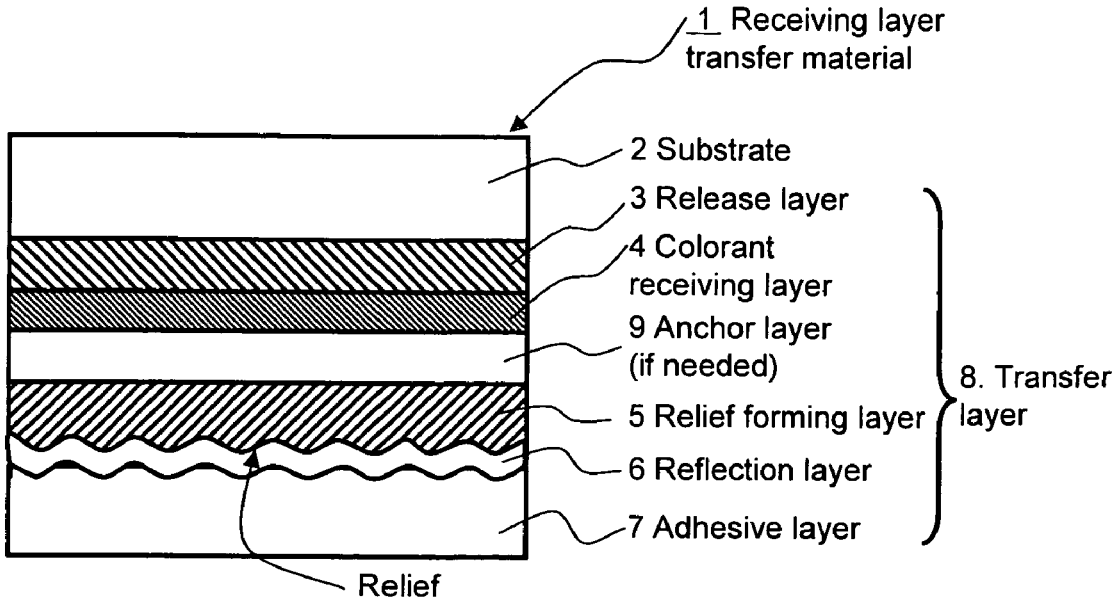
FIG. 1 is a sectional view of a receiving layer transfer material according to the present invention.

In the drawings, 1 refers to a receiving layer transfer material, 2 refers to a substrate, 3 refers to a release layer, 4 refers to a colorant receiving layer, 5 refers to a relief forming layer, 6 refers to a reflection layer, 7 refers to an adhesive layer, 8 refers to a transfer layer, 9 refers to an anchor layer, 10 refers to a heat resistant smooth layer, 11 refers to an object (medium), 12 refers to a thermal transferred image by the colorant, 13 refers to an image-formed object, 51 refers to a printer head, and 52 refers to a platen roller.

BEST MODE FOR CARRYING OUT THE INVENTION

Embodiments of the present invention will now be explained in detail, with reference to drawings.

In this specification, "ratio", "part", "%" and so on which indicate composition are based on mass, and slash "/" means integrally layered structure.

Furthermore, "OVD" means "Optical Variable Device", "PET" means "polyethylene terephthalate", "region including red dye" refers to as "R region", "region including green dye" refers to as "G region", "region including blue dye" refers to as "B region", "region including yellow dye" refers to as "Y region", "region including magenta dye" refers to as "M region", "region including cyan dye" refers to as "C region" and "region including black dye" refers to as "K region". These terms are any of abbreviation, functional expression, common name or jargon in this field.

In the definition of film and sheet according to JIS-K6900, sheet means a thin and flat product which generally has a thickness relatively smaller than the length or width thereof, whereas film means a thin and flat product which has a thickness considerably thinner than the length or width thereof, and of which the maximum thickness is limited in any way, and which is supplied in a form of roll. Therefore, it can be said that a sheet of which thickness is very thin is a film. Thus, there is no definite border between sheet and film, and thereby it is difficult to definitely distinguish sheet and film from each other. Therefore, in this specification, "sheet" is defined as a product including both thicker product and thinner product.

Furthermore, in this specification, "(meth)acryl" means "acryl and/or methacryl", and "(meth)acrylate" means "acrylate and/or methacrylate".

FIG. 1 is a vertical section schematically indicating an example of a receiving layer transfer material according to the present invention. In FIG. 1, the receiving layer transfer material 1 is provided with: a release layer 3, a colorant receiving layer 4, a relief forming layer 5, a reflection layer 6 and an adhesive layer 7, which are formed in this order on one surface of a substrate 2. This receiving layer transfer material is laminated with an object in such a manner that the adhesive layer of the transfer material faces with the object. Then, the adhesive layer, the reflection layer, the relief forming layer and the dye receiving layer are transferred onto the object via a heating device such as a thermal head. Here, the laminated structure made of the colorant receiving layer 4, the relief forming layer 5, the reflection layer 6 and the adhesive layer 7 refers to as a transfer layer 8, since this laminated structure is transferred onto the object. The substrate 2 and the release layer 3 are a part to be peeled off and separated from the object, when the receiving layer transfer material is peeled off from the object after thermal transferring.

The reflection layer 6 is formed on the relief forming layer 5 at a relief forming side. In an example of FIG. 1, the colorant receiving layer 4, the relief forming layer 5 and the reflection layer 6 are formed in this order. Because the relief forming side of the relief forming layer 5 is directed away from the colorant receiving layer 4. The relief forming side of the relief forming layer 5 may be directed toward the colorant receiving layer 4. In this case, the colorant receiving layer, the reflection layer and the relief forming layer are formed in this order.

Figure 2:
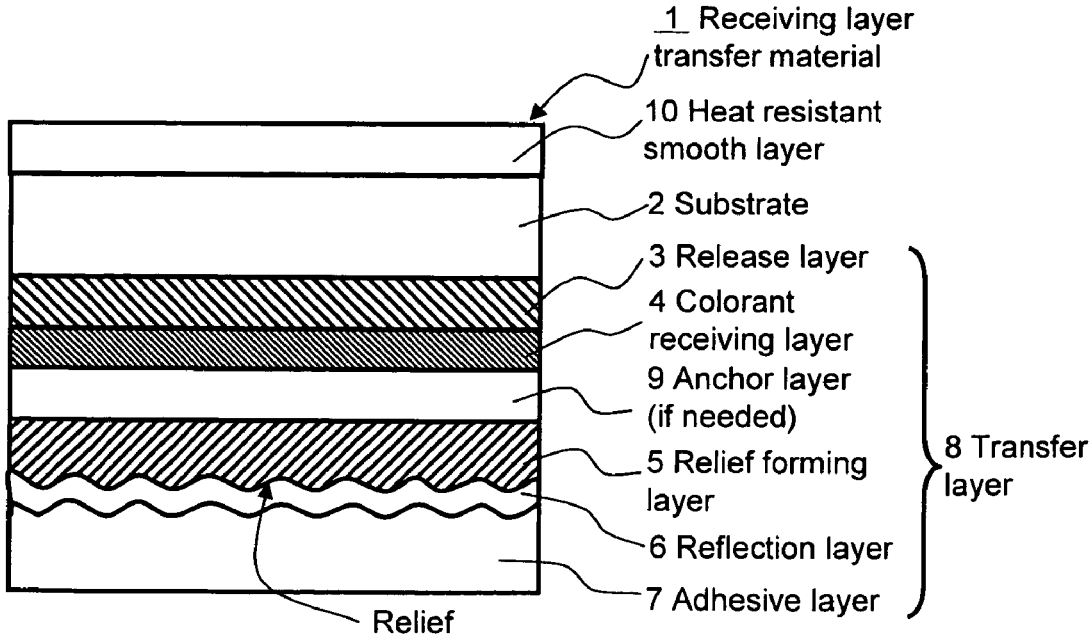
FIG. 2 is a sectional view of another receiving layer transfer material according to the present invention.

FIG. 2 is a vertical section schematically indicating another example of a receiving layer transfer material according to the present invention. In FIG. 2, the receiving layer transfer material 1 is provided with: a release layer 3, a colorant receiving layer 4, an anchor layer 9, a relief forming layer 5, a reflection layer 6 and an adhesive layer 7, which are formed in this order on one surface of the substrate 2. On another surface of the substrate 2, a heat resistant smooth layer 10 is formed. In this case, the layered structure made of the colorant receiving layer 4, the anchor layer 9, the relief forming layer 5, the reflection layer 6 and the adhesive layer 7 is transferred, as a transfer layer 8, onto the object. A layered structure made of the heat resistant smooth layer 10, the substrate 2 and the release layer 3 is peeled off and separated from the object, when the receiving layer transfer material is peeled off from the object after thermal transferring.

In the relief forming layer 5, there is formed a relief structure to exert a visual effect. Example of the visual effect of the relief structure used in the present invention includes a function to display a hologram image. In the present invention, "hologram" in the term "hologram image" means such that has a relief structure such as a hologram or diffraction grating, which can display a specific decorative image or stereoscopic image. Another example of the visual effect of the relief structure includes a function to cause white diffusion or white reflection within a specific angle range.

In the colorant receiving layer laminated on the relief forming layer 5, it is possible to form an image represented with colorant by various on-demand printing systems including a thermal transfer system such as sublimation heat transfer or thermal wax transfer, an inkjet system, an electrophotographic system and so on. Therefore, it is possible to obtain an image of sophisticated design provided with an image represented with colorant and the visual effect due to the relief forming layer by transferring the transfer layer 8 including the relief forming layer 5 and the colorant receiving layer 4 from the receiving layer transfer material according to the present invention to the object, and by forming an image in the transfer layer with colorant. For example, it is possible to obtain an image which is a combination of a hologram image and a thermal transfer image, in the case that the relief forming layer has the hologram image. It is possible to obtain an image which is a combination of white light from the relief forming layer and a thermal transfer image, in the case that the relief forming layer has a function to cause a white diffusion or a white reflection within a specific angle range.

Main Use:

The main use of the "image-formed object" using the receiving layer transfer material and the transfer sheet according to the present invention may be: for example, cash vouchers such as stock certificates, securities, bonds, gift certificates, checks, bills, entrance tickets, passbooks, transport tickets, riding tickets, stamps, postal stamps, viewing tickets and other tickets; cards such as cash cards, credit cards, ID cards, prepaid cards, members cards, IC cards and optical cards; greeting cards; post cards; business cards; ID photos of various IDs such as drivers licenses and passports; wrapping material such as cartons, cases and soft packages; bags; forms; envelops; tags; OHP sheets; slide films; bookmarks; books; magazines; calendars; posters; pamphlets; print club (registered trademark); menus; passports; POP products; coasters; displays; name plates; keyboards; cosmetics; accessories such as list watch and cigarette lighter; stationeries such as writing materials and report papers; architectural materials; panels; emblem; keys; fabrics; clothing; footwear; radio; television; equipments such as calculators and OA equipments; various sample books; albums; computer graphic outputs; medical image outputs and so on. However, the use is not limited particularly, insofar as it involves a specific or special design, or security.

Now, each layer constituting the receiving layer transfer material according to the present invention will be explained in detail.

(Substrate)

As the substrate 2, it is possible to use various materials depending on individual use, insofar as heat resistance capable of resisting heat of a thermal head or the like, mechanical strength, mechanical strength and solvent resistance capable of withstanding the manufacturing process are obtained. For example, it is possible to use polyester resins such as polyethylene terephthalate, polybutylene terephthalate, polyethylene naphthalate, polyethylene terephthalate-isophthalate copolymer, terephthalic acid-cyclohexane dimethanol-ethylene glycol copolymer, and polyethylene terephthalate-polyethylene naphthalate co-extrusion film. It is possible to use other materials such as polyamide resins, acrylic resins, imide resins and cellulose films. Polyethylene terephthalate is the most suitable because of its high heat resistance and high mechanical strength.

The substrate may be co-polymer resin or mixture (including polymer alloy) including the above listed resins as main constituent, or may be a layered structure made of a plurality of layers thereof. Furthermore, the substrate may be oriented film, or may be non-oriented film. Nevertheless, it is preferable to use monoaxially-oriented or biaxially-oriented film for a purpose of improving the strength thereof. Furthermore, it is preferable that the substrate 2 is subjected to a treatment for improving the adhesiveness of a surface of the substrate 2 onto which the release layer is to be formed. The thickness of the substrate may be 0.5~50 μm, more preferably 2.5~12 μm, the most preferably 4~6 μm. If the thickness becomes thicker than this range, the heat transfer of the thermal head becomes worse. If the thickness becomes thinner than this range, the mechanical strength becomes insufficient. The substrate may be used in a form of film, sheet or board made of at least one layer of these resin materials.

(Release Layer)

The receiving layer transfer material is provided with the release layer 3 between the substrate and the dye receiving layer. When heated, the transfer layer including the receiving layer becomes easy to peel off from the substrate. In the receiving layer transfer material, separation is occurred between the release layer 3 and the dye receiving layer at the time of thermal transferring.

The release layer is made of materials having a good releasability from the mold such as waxes, silicone wax, silicone resins, fluorocarbon resin, or resins having a relatively high melting point so as not to fuse by heat of the thermal head, or resin materials made of these resins and heat release agent such as wax which is included in these resins.

Resins having a relatively high melting point may be, for example, acrylic resins, polyurethane resins, polyvinyl acetal resins, polyester resins, styrene resins, polycarbonate resins, polyether resins, nitrocellulose, ethylcellulose, cellulose derivatives, other cellulose resins and so on, or may be chlorinated polyolefin resins, polyalylate resins, hydrogenated norbornene resins, polyimide resins, poly(amide-imide) resins, polyether ketones such as polyether ether ketone resins (PEEK) or polyether ketone resins (PEEK), polyethersulfone resins, polysulfone resins, polyphenylene oxide resins and so on. These resins may be used solely or as a mixture. To these resins or the mixture thereof, there is added, as an ingredient having a dye-receiving function, halogenated resins such as polyvinyl chloride or polyvinylidene chloride, vinyl resins such as polyvinyl acetate, vinyl chloride-vinyl acetate copolymer, ethylene-vinyl acetate copolymer or polyacrylic ester, polyester resins such as polyethylene terephthalate or polybutylene terephthalate, polystyrene resins, polyamide resins, copolymer resins of olefin such as ethylene or propylene and other vinyl polymer, cellulose resins such as ionomer or cellulose diastase, polycarbonate and so on. Furthermore, in order to further improve the "hakugire" property, it is possible to use the ionizing radiation curable resin which is substantially the same as that of the relief forming layer.

In particular, as a thermoplastic resin which has a good adhesiveness between the release layer 3 and the substrate 2 and has a good dye-receiving ability, polyester resins, copolymer including at least one of vinyl chloride or vinyl acetate are preferable.

In the case that the ionizing radiation curable resin is used as the release layer 3 resin, it is possible to cure the release layer 3 and the relief forming layer by the ionizing radiation after a predetermined amount of the thermoplastic resin is mixed into the ionizing radiation curable resin of the release layer 3, and thereby provide the release layer 3 with both the releasing ability and the receiving ability. It is assumed that the ionizing curable resin contributes to the releasing ability and the thermoplastic resin contributes to the receiving ability under the condition that the thermoplastic resin having the dye receiving ability is suitably dispersed in the ionizing radiation-cured resin. That is, by selecting the content ratio of the ionizing radiation curable resin and the thermoplastic resin in the release layer 3, as well as selecting materials of the ionizing radiation curable resin and the thermoplastic resin, it is possible to avoid the detachment or displacement of the relief forming layer due to the vibration or shock during the transportation or handling of the receiving layer transfer material 1 in the case of the receiving layer transfer material 1, and during transferring it is possible to release the release layer easily from the substrate and transfer the transfer layer. The transfer layer which is transferred as such exposes its surface as the release layer 12, onto which an image can be easily printed via a thermal printer using a sublimation ink ribbon.

With regard to the content ratio of the ionizing radiation curable resin and the thermoplastic resin, the ionizing radiation curable resin is preferably 80-99 wt. % (percent by weight) relative to the release layer composition, and the thermoplastic resin is preferably 1 to 20 wt. % relative to the release layer composition. The ionizing radiation curable resin to be used for the release layer 3 can be substantially the same as the ionizing radiation curable resin for the relief forming layer, which is discussed later. Here, "substantially" means a fact that the fundamental skeleton or reaction scheme is common but substituent or chain length may be different. Furthermore, in the calculation of the content ratio, any releasing agent or any reactive monomer which is added to the ionizing radiation curable resin for the reaction, and the like, is counted as the ionizing radiation curable resin amount. The same goes for the description or explanation hereinafter.

In this specification, the ionizing radiation curable resin means a precursor which is not irradiated with the ionizing radiation and not cured, whereas the ionizing radiation-cured resin means a resin which is irradiated with the ionizing radiation and cured.

In order to form the release layer, various additives (if needed) are added to the above-mentioned materials, and dissolved or dispersed into an organic solvent to form a release layer composition (ink).

As the organic solvent, any organic solvent can be used insofar as the resin is dissolved therein. Nevertheless, taking into account the applicability or driability, the organic solvent may be an aromatic solvent such as toluene or xylene, ketone solvent such as acetone, methyl ethyl ketone (MEK), methyl isobutyl ketone or cyclohexanone, cellosolve organic solvent such as methyl cellosolve or ethyl cellosolve. Especially, mix solvent of these solvents is preferably used.

The release layer composition (ink) is applied and dried by any known coating method or printing method. The coating method may be for example gravure direct coating, gravure reverse coating, knife coating, air coating, roll coating, reverse coating, transfer roll coating, gravure coating and so on. The thickness of the release layer is usually about 0.1 to about 10 μm, preferably 0.2 to 5 μm. The amount of the application is sufficiently about 0.1 to 5 $g/m^2$ on dried state basis. In the case that a mat dye receiving layer is preferred after transferring, it is possible to mat the surface by adding various particles to the inside of the release layer, or by matting a dye receiving layer side surface of the release layer.

In the case that the ionizing radiation curable resin is used as the release layer 3, especially in the case that the substrate is thin, the hakugire property become worse if the release layer 3 is made of the ionizing radiation curable resin only. However, it is possible to print an image without any flash and defect even in the case of fine dot by adding the thermoplastic resin.

If the thickness of the substrate is 9 μm or more, such an influence is small. If the thickness of the substrate is 6 μm or less, an influence of the thermal head become large. Especially, if the thickness of the substrate is 4.5 μm or less, this influence is remarkable. Generally, the release layer 3 remains on a substrate 2 side after transferring. In some cases, however, a part of the release layer 3 may be transferred to an object side. This case is within the scope of the invention, since the function is the same.

(Colorant Receiving Layer)

The colorant receiving layer 4 is for maintaining a formed image by receiving colorants used in an on-demand printing after transferred onto any object. The on-demand printing includes for example sublimation heat transfer printing, thermal wax transfer printing, inkjet printing, an electrophotographic printing and so on. It is possible to form the colorant receiving layer by using a known resin material which can easily receive the colorant, depending on the printing method to be used.

Now, an explanation will be focused on the dye receiving layer to be used in the sublimation heat transfer printing. Materials for the dye receiving layer may be for example: olefin resin such as polypropylene; halogenated resin such as polyvinyl chloride or polyvinylidene chloride; vinyl resin such as polyvinyl acetate, vinyl chloride-vinyl acetate copolymer, ethylene-vinyl acetate copolymer or polyacrylic ester; polyester resin such as polyethylene terephthalate or polybutylene terephthalate; polystyrene resin; polyamide resin; copolymer resin of olefin such as ethylene or propylene with other vinyl polymer; cellulose resin such as ionomer or cellulose diacetate; thermoplastic resin such as polycarbonate, polyvinyl acetal resin or polyvinyl alcohol resin. Among them, vinyl resin, vinyl chloride resin, acryl-styrene resin or polyester resin are particularly preferable.

It is preferable to include the releasing agent in the dye receiving layer, in order to prevent the lowering of the printing sensitivity, or thermal adhesive between the dye receiving layer and the thermal transfer sheet provided with a dye layer including sublimation dye. Such a releasing agent may be silicone oil, phosphoric ester surfactant and fluoro surfactant. Specifically, in view of the releasability from the sublimation dye layer, it is preferable to use at least one kind selected from a group consisting of modified silicone oil such as epoxy modified silicone oil, methyl styrene modified silicone oil, polyether modified silicone oil, amino modified silicone oil, alkyl modified silicone oil, carboxyl modified silicone oil, alcohol modified silicone oil, fluorine modified silicone oil, olefin modified silicone oil and carbinol modified silicone oil. The additive amount of the releasing agent is preferably 0.5 to 30 wt. parts relative to 100 wt. parts of the receiving layer forming resin. If the additive amount is less than this range, the thermal adhesion may be caused between the thermal transfer sheet and the dye receiving layer, or the printing sensitivity may be lowered. By adding such a releasing agent, the releasing agent bleeds out onto a surface of the receiving layer after transferring and thereby the surface of the receiving layer has the releasability.

The dye receiving layer can be formed by dissolving or dispersing one or more materials selected from the above-listed materials, and various additives if needed, in an appropriate solvent such as water or organic solvent to prepare a coating liquid for the dye receiving layer, and then applying and drying this coating liquid by a method such as gravure printing. The thickness of the coating layer is based on the dried state.

The dye receiving layer is formed by preparing a receiving layer forming coating liquid from a predetermined amount of the above-mentioned thermoplastic resin, a predetermined amount of the releasing agent, a predetermined amount of various additives if needed, and a predetermined amount of solvent such as organic solvent, and applying and drying this coating liquid by a known method such as gravure direct coating, gravure reverse coating, knife coating, air coating, roll coating and screen coating so that the thickness becomes about 1 to about 10 μm on the dried state basis, the coating amount becomes 0.2 to 5 g/m$^2$, preferably 0.3 to 3 g/m$^2$ on the dried state basis. If the thickness of the dye receiving layer is too thin, it is difficult to obtain the sufficient dye printing concentration, the sufficient adhesiveness and the sufficient releasability from the thermal transfer sheet when printing. If the thickness is too thick, it is difficult to obtain the sufficient inter-layer adhesiveness, the sufficient transfer characteristics ("kire" property), although it is possible to obtain the printing concentration. Thereby, it becomes difficult to transfer the accurate pattern.

(Relief Forming Layer)

Materials for the relief forming layer 5 may be: thermoplastic resin such as polyvinyl chloride, acrylic resin (e.g. polymethyl(meth)acrylate), polystyrene and polycarbonate; or cured thermosetting resin such as unsaturated polyester, melamine, epoxy, polyester(meth)acrylate, urethane(meth) acrylate, epoxy(meth)acrylate, polyester(meth)acrylate, polyol(meth)acrylate, melamine(meth)acrylate and triazine acrylate; cured UV curable resin such as composition made of a mixture obtained by appropriately mixing unsaturated ethylene monomer and unsaturated ethylene oligomer, and the sensitizer which is added to the mixture; or a mixture of the above-mentioned thermoplastic resin and the above-mentioned thermoplastic resin and a thermoforming material having a radical polymerizable unsaturated group. Specifically, thermosetting resin or ionizing radiation curable resin which can be cured by UV rays or electron beam are preferable, because of their excellent durability including chemical resistance, light resistance and weather resistance. The ionizing radiation curable resin may be for example a cured state of the ionizing radiation curable resin such as epoxy modified acrylate resin, urethane modified acrylate resin and acryl modified polyester resin. Urethane modified acrylate resin is preferable.

The relief forming layer composition (ink) is formed by dissolving or dispersing the above-mentioned material such as urethane modified acrylic resins as the ionizing radiation curable resin in organic solvent, with various additives are added if needed such as polyfunctional monomer or oligomers, releasing agent, organometallic coupling agent and photoinitiator. The relief forming layer composition (ink) is applied and dried on the release layer by a known coating method or printing method. The coating method or printing method may be the same method as in the case of forming the release layer. The thickness of the relief forming layer is usually about 0.1 to about 10 g/m$^2$, preferably 0.2 to 5 g/m$^2$ on the dried state basis.

(Formation of the Relief Forming Layer with Hologram Image)

As a visual effect of the relief forming layer, it is possible to form a hologram image by forming a relief on a surface of the relief material layer. It is sufficient that the relief is a corrugated relief. For example, it may be in a form of corrugated surface pattern (optical diffraction pattern) from which a two dimensional (2D) image or three dimensional (3D) image can be reproduced. Such a corrugated surface pattern may be hologram or diffraction grating in which the light intensity distribution of interference fringes due to light interference between objection light and reference light is recorded as a corrugated pattern. The hologram includes laser hologram such as Fresnel hologram, white-light hologram such as rainbow hologram, as well as color hologram, computer generated hologram (CGH), holographic diffraction grating, all of which utilize the principle of laser and/or white-light hologram. The diffraction grating includes holographic diffraction grating which utilizes a hologram recording method. Furthermore, the diffraction grating includes a diffraction grating which is mechanically made by using an electron beam lithography system and the like and which can obtain any desired diffraction light based on calculation. These hologram and/or diffraction grating may be recorded solely or multiplexedly, or may be recorded in combination with each other. Examples of other corrugated surface pattern besides the hologram or diffraction grating includes line-like relief, interference pattern, Fresnel lens and lenticule lens.

(Formation of Relief Forming Layer Having White Light Reflecting Function)

As other visual effect of the relief forming layer, it is possible to form a relief pattern having white light reflecting function which diffuses white light or reflects white light in a specific angle range. The relief pattern is CGH (Computer Generated Hologram) which can be observed as white color in a desired observation region. The CGH is one which diffuses the incident light into a predetermined angle range when the incident light having a predetermined standard wavelength $\lambda_{sta}$ is incident on the CGH with a predetermined incident angle $\theta$, and it may be designed so that the maximum diffraction angle $\beta 2_{min}$ of incident light with the incident angle $\theta$ at the shortest wavelength $\lambda_{min}$ is greater than the minimum diffraction angle $\beta 1_{max}$ of incident light with the incident angle $\theta$ at the longest wavelength $\lambda_{max}$, wherein the shortest wavelength $\lambda_{min}$ and the longest wavelength $\lambda_{max}$ define a wavelength range of $\lambda_{min}$-$\lambda_{max}$ which includes the standard wavelength $\lambda_{sta}$ and enables zero order transmitted light or zero order reflected light of the incident light with the incident angle $\theta$ to be observed as white color when performing additive color mixing.

More specifically, the CGH is one which diffuses the incident light into a predetermined angle range when the incident light having a predetermined standard wavelength is incident on the CGH with a predetermined incident angle, and it may be designed so that the maximum diffraction angle of incident light with the incident angle at the shortest wavelength is greater than the minimum diffraction angle of incident light with the incident angle at the longest wavelength, wherein the shortest wavelength and the longest wavelength define a wavelength range which includes the standard wavelength and enables zero order transmitted light or zero order reflected light of the incident light with the incident angle to be observed as white color when performing additive color mixing.

In this case, the CGH may be a CGH comprising a collection of fine cells disposed in a 2D (two dimensional) array, in which each cell has: an optical path length for providing a specific phase to the reflected light or the transmitted light; and a phase distribution obtained by adding the first phase distribution to the second phase distribution in which the first phase distribution does not diffract substantially the incident light to the outside of an observation range when the light flux of the incident light with the right incident angle is substantially diffracted within the observation range, and the second phase distribution outputs the light flux vertically which enters with a predetermined incident angle from an oblique direction.

Furthermore, the CGH may be a CGH comprising a collection of fine cells disposed in a 2D (two dimensional) array, in which each cell has: an optical path length for providing a specific phase to the reflected light or the transmitted light; and a phase distribution which substantially diffracts the light flux of the incident light with a predetermined incident angle from an oblique direction within a predetermined observed range and does not diffract the light flux to the outside of the observation range, and a phase distribution which diffracts substantially the light flux of the incident light with the right incident angle into another range shifted from the predetermined observation range and does not diffract substantially the light flux to the outside of said another range. Furthermore, fine cells are practically arranged in a grid.

Furthermore, it may be designed so that the shortest wavelength is 450 nm and the longest wavelength is 650 nm. Furthermore, when the incident angle of the illumination light is defined as $\theta$, the shortest wavelength is defined as $\lambda_{min}$ and the longest wavelength is defined as $\lambda_{max}$, it is desirable that the minimum diffraction angle $\beta 1_{sta}$ and the maximum diffraction angle $\beta 2_{sta}$ at the standard wavelength $\lambda_{sta}$ satisfy the following formula.

$$\lambda_{min}/\lambda_{max}=(\sin \beta 1_{sta}-\sin \theta)/(\sin \beta 2_{sta}-\sin \theta)$$

Furthermore, when the shortest wavelength is defined as $\lambda_{min}$ and the longest wavelength is defined as $\lambda_{max}$ and the minimum diffraction angle and the maximum diffraction angle at the standard wavelength $\lambda_{sta}$ is defined as $\beta 1_{sta}$ and $\beta 2_{sta}$, respectively, it is desirable that the incident angle $\theta$ satisfies the following formula.

$$\sin \theta=(\lambda_{max} \sin \beta 1_{sta}-\lambda_{min} \sin \beta 2_{sta})/(\lambda_{max}-\lambda_{min})$$

The relief pattern which is a reproduction of such a CGH is useful as a reflector. In a wavelength range within which white is observed in the case that an additional color mixing is performed including the standard wavelength relative to the zero order transmitted light or the zero order reflected light of the incident light with a predetermined incident angle, the maximum diffraction angle of the incident light with such an incident angle at the shortest wavelength in the wavelength range is greater than the minimum diffraction angle of the incident light with such an incident angle at the longest wavelength in the wavelength range. Thereby, in a range between the maximum diffraction angle at the shortest wavelength and the minimum diffraction angle at the longest wavelength, white color can be observed and the observed color does not change even if the viewpoint is shifted.

Specifically, for example, the hologram surface phase is distributed by dividing cells in a grid of 32 by 32, and dividing the reproduction image surface of the angle display also in a grid of 32 by 32. However, in order to form an actual CGH, a desired diffraction light can be obtained and white light can be obtained within the distribution range of the diffraction light by calculating with the incommensurable number of cells. The details is disclosed in the Japanese Patent Application No. 2001-337584 by the same applicant, "Computer generated hologram and reflection liquid display device".

Usually, "pattern transferring" is achieved by pressing (embossing) a stamper (metal stamper or resin stamper) having a relief surface onto a surface of a relief material layer, forming (reproducing) the relief to a relief forming layer and then the stamper is peeled off. The commercial method to form a relief is comprised of the steps including embossing a metal or resin stamper onto a surface of the relief forming layer to form a relief and then irradiating any ionizing radiation, or irradiating any ionizing radiation during embossing, and then peeling off the stamper. Such a commercial reproduction can be a continuous reproduction by performing the reproduction on an elongate relief material layer.

In the case of using the ionizing radiation curable resin as the relief forming material layer, the ionizing radiation is irradiated during embossing or after embossing to cure the ionizing radiation curable resin. In the case of curing the resin during embossing, the curing process may be performed in a situation that the stamper is pressed onto the surface of the relief material layer.

The ionizing radiation curable resin mentioned above becomes ionizing radiation cured resin (relief forming layer) when cured (reacted) by the irradiation of the ionizing radiation after a relief is formed. The ionizing radiation may be defined by quantum energy of electromagnetic wave. In the present invention, however, the ionizing radiation shall be defined as such including all UV rays such as UV A, UV B and UV C, visible light, gamma ray, X ray and electron ray. Therefore, UV rays, visible light, gamma ray, X ray and electron ray may be employed as the ionizing radiation. Among these, UV rays are suitable, and in particular, UV ray of wavelength 300 to 400 nm is optimum. Into the ionizing radiation curable resin which can be cured by the irradiation of the ionizing radiation, photopolymerization initiator and/or photopolymerization accelerator may be added in the case of curing by the UV rays, while no additive may be added in the case of curing by the electron ray of high energy. Furthermore, if an appropriate catalyst exists, the curable resin can be cured by thermal energy.

(Reproduction of Relief)

In a suitable specific example, a method referred to as semi-dry process (SD process) is employed. The reproduction apparatus is provided with a pair of main frames anchored to a bed. To these main frames, a paper feeder, a transferring device, an irradiating device and a winding device are sequentially attached. The paper feeder and the winding device are devices for providing or winding a roll. The transferring device is provided with: an emboss roller of which axis rotatably on a bearing fixed to a central portion of the main frames; a pressing roller supported rotatably by a pair of arms; and a pressurizing mechanism. A form of elongate laminated belt of heat resistant smooth layer 10 (if needed)/substrate 2/release layer 3/colorant receiving layer 4/anchor layer 9 (if needed)/relief forming layer 5 is supplied from the paper feeder and pressed by the emboss roller and the pressing roller. The metal or resin stamper is disposed around a circumferential surface of the emboss roller. The stamper is pressed onto the heated pressing roller at a constant pressure. The corrugated-like profile (relief) of the stamper is transferred onto the surface of the relief forming layer 5. Immediately after the relief forming layer is peeled off from the stamper, UV ray is irradiated from a UV irradiating device, so that the relief forming layer 5 carrying the corrugated-like profile on the surface is cured. After that, the elongated laminated belt is wound to the winging device. The details is disclosed in Japanese Patent Publication after examination Nos. H6-85103, H6-85104, H7-104600 and so on.

(Reflection Layer)

The hologram reproduction image and/or diffraction grating become clearly visible by disposing the reflection layer 6 on the relief surface of the relief forming layer on which a relief configuration such as hologram or diffraction grating is formed. The reflection layer includes a reflection type which utilizes metal for reflecting light, and a transparent type. The reflection type reflection layer may be made of metal such as Cr, Ni, Ag, Au and Al, or their oxide, sulfide, nitride or the like, in a form of single or laminated thin film. The transparent type reflection layer may be made of transparent metal compound having a refractive index different from that of the relief forming layer surface. For example, such material may be ZnS, tin oxide and titanium oxide. The term "transparent" means that visible light sufficiently transmits through this "transparent" material. And, "transparent" includes a transparent state with color or without color. The metal or transparent metal compound mentioned above can be formed so as to have a thickness of 10 to 2000 nm, preferably 20 to 1000 nm by vacuum coating technology including vacuum deposition, sputtering, ion plating and so on. If the thickness of the reflection layer is less than this range, some extent of light transmission reduces the reflection effect. The thickness of the reflection layer more than this range waste the cost, because the reflection effect does not change even though the thickness becomes thicker than this range.

(Adhesive Layer)

The adhesive layer 7 located at the outermost surface of the receiving layer transfer material of the present invention may be thermal adhesive material which obtains the adhesiveness by thermally melting or softening. For example, it may be ionomer resin, acid-modified polyolefin resin, ethylene-(meth)acrylic acid copolymer, ethylene-(meth)acrylic ester copolymer, polyester resins, polyamide resins, vinyl chloride resins, vinyl acetate resins, vinyl chloride-vinyl acetate copolymer, (meth)acrylic resins such as acrylic resins or methacrylic resins, acrylic ester resin, maleic acid resin, butyral resin, alkyd resin, polyethyleneoxide resin, phenol resins, urea resin, melamine resin, melamine alkyd resin, cellulosic resins, polyurethane resins, polyvinylether resin, silicone resin, gum resins and so on. These resins may be used solely or in combination.

These resins of the adhesive layer is selected in view of the affinity with the object. Generally, in view of the adhesiveness or the like, acrylic resins, butyral resins, polyester resins are suitable. The adhesive layer can be formed in the same manner as the above-mentioned method for forming the release layer. The thickness of the adhesive layer is usually 0.05 to 10 μm, preferably 0.1 to 5 μm. The coating amount based on dried state is usually 0.05 to 10 $g/m^2$, preferably 0.1 to 5 $g/m^2$. If the thickness of the adhesive layer is less than this range, the adhesiveness with the object becomes so weak that the adhesive layer is dropped off. If the thickness of the adhesive layer is more than this range, it wastes the cost, because the adhesive effect does not change although the adhesive effect is sufficient. Furthermore, the heat of the thermal head is wasted. Furthermore, if needed, additives such as filler, plasticizer, colorant and antistatic agent may be added to the adhesive layer. The filler may be extender pigment such as silica and calcium carbonate. Particularly, the addition of the extender pigment improves the "hakugire" property. The antistatic agent may be non-ionic surfactant, anionic surfactant or cationic surfactant, or may be polyamide or acrylic acid derivative.

The adhesive layer 7 is formed by dispersing or dissolving the above-mentioned thermal adhesive region into a solvent to obtain a compound (ink), and coating and drying the ink by a known coating method or known printing method. The coating or printing method can be the same method as in the case of forming the release layer. During drying, if needed, brushing may be employed in order to improve the printability.

(Anchor Layer)

Between the dye receiving layer and the relief forming layer in the receiving layer transfer material of the present invention, the anchor layer 9 may be disposed in order to improve the adhesiveness of both layers. The anchor layer may be, for example, polyurethane resins, polyester resins, polyamide resins, epoxy resins, phenol resins, polyvinyl chloride resins, polyvinyl acetate resins, vinyl chloride-vinyl acetate copolymer, acid-modified polyolefin resins, copolymer of ethylene with vinyl acetate or acrylic acid, (meth) acrylic resins, polyvinyl alcohol resins, polyvinyl acetal resins, polybutadiene resins, gum resins, petroleum resins, alkyl titanate compounds, polyethelenimine compounds, isocyanate compounds, melamine resin, starch, casein, gum Arabic, cellulose derivatives, waxes, and so on.

To the main ingredient made of the above listed resin, as well as monomer, oligomers, prepolymer and the like thereof, various additives such as stabilizer, filler, initiator, curing agent and cross-linking agent may be added, if needed, solely or in combination. Furthermore, it is possible to use a combination of the main compound and the curing agent as one component curing type resin or two component curing type resin.

The anchor layer 9 preferably has the compatibility or affinity with both the colorant receiving layer 4 and the relief forming layer 5. Particularly, the anchor layer 9 preferably includes both the material of the colorant receiving layer 4 and the material of the relief forming layer 5.

These resins are dissolved or dispersed into a suitable solvent, and sufficiently kneaded as appropriate, so as to prepare the coating compound (ink, coating liquid). The coating compound may be coated and dried by any known coating method such as roll coating, gravure coating, spray coating, air knife coating, kiss coating, reverse roll coating and the like, to obtain the anchor layer 9. Otherwise, the anchor layer 9 is formed by a reaction during drying or during aging after drying. The thickness of the anchor layer is about 0.05 to 10 μm, preferably 0.1 to 5 μm. The coating amount based on the dried state is about 0.1 to 5 $g/m^2$. However, if the resin constituting the relief forming layer has a good adhesiveness with the dye receiving layer, there is no need to dispose the anchor layer.

Disposing the anchor layer has an advantage that the adhesiveness between the colorant receiving layer and the relief forming layer is improved. However, disposing the anchor layer has a disadvantage that the total thickness of the receiving layer transfer material becomes thinner, and the releasability (hakugire) during thermal transferring becomes lowered, and the resolution is reduced. In view of this, there are the following approaches which improves the adhesiveness between the colorant receiving layer and the relief forming layer, without increasing the total thickness of the receiving layer transfer material as seen in the case of disposing the anchor layer.

1. Adding the material (constitutional resin) of the relief forming layer to the colorant receiving layer.

2. Adding the material (constitutional resin) of the colorant receiving layer to the relief forming layer.

3. Adding the material (constitutional resin) of the relief forming layer to the colorant receiving layer, and adding the material (constitutional resin) of the colorant receiving layer to the relief forming layer.

By conducting any one of the above three approaches, the disadvantage of disposing the anchor layer can be avoided. Particularly, the approach denoted as numeral 1 is more suitable. In this case, the material of the relief forming material is preferably added at 20 to 80 wt. % of the solid content ratio.

(Heat Resistant Smooth Layer)

The receiving layer transfer material of the present invention may have the heat resistant smooth layer 10 at the opposite side of the side of the substrate on which the transfer layer including the colorant receiving layer and the like are formed on the substrate, in order to avoid some adverse effects such as sticking or printing wrinkle due to heat of the thermal head.

The basic constituents of the heat resistant smooth layer 10 are heat resistant thermoplastic resin binder and substance acting as thermal releasing agent or lubricant. The heat resistant thermoplastic resin binder can be selected wide range. Suitable examples of such a binder includes polyvinyl butyral resin, polyvinyl acetoacetal resin, polyester resin, vinyl chloride-vinyl acetate copolymer, polyether resins, polybutadiene resin, styrene-butadiene copolymer, acryl polyol, polyurethane acrylate, polyester acrylate, polyether acrylate, epoxy acrylate, urethane or epoxy prepolymer, nitrocellulose resin, cellulose nitrate resin, cellulose acetate propionate resin, cellulose acetate butyrate resin, cellulose acetate hydrodiene phthalate resin, cellulose acetate resin, acryl resin, aromatic polyamide resin, polyamide resin, polyimide resin, poly (amide-imide) resin, polycarbonate resin, chlorinated polyolefin resin, styrene-acrylonitrile copolymer, styrene-maleic acid copolymer, cyclized rubber, polyvinyl alcohol and so on.

The lubricant which is added to or coated on the heat resistant smooth layer made of these resins may be silicone polymer such as phosphoric ester, silicone oil, graphite powder, silicone-based graft polymer, fluorine-based graft polymer, acryl silicone graft polymer, acryloyl siloxane and aryl siloxane. Preferably, it may be a layer made of polyol such as polyalcohol polymer compound, polyisocyanate compound and phosphoric ester compound. More preferably, filler may be added.

The composition consisting the heat resistant smooth layer 10 is formed by mixing 10 to 100 wt. parts of substance acting as the above mentioned lubricant or thermal release agent relative to 100 wt. parts of the thermoplastic resin binder.

The heat resistant smooth layer can be formed by coating and drying a heat resistant smooth layer coating liquid, which is prepared by dissolving or dispersing the above mentioned resin, lubricant and filler into an appropriate solvent, onto a substrate, by a forming method such as gravure printing, screen printing, roll coating, reverse coating with gravure plate. The coating amount of the heat resistant smooth layer is preferably 0.1 $g/m^2$~4.0 $g/m^2$ on the solid content basis. In order to secure the attachment of the substrate 2 and the heat resistant smooth layer 10, a primer layer may be provided on the substrate 2 in advance.

(Image Forming Method)

Figure 4:
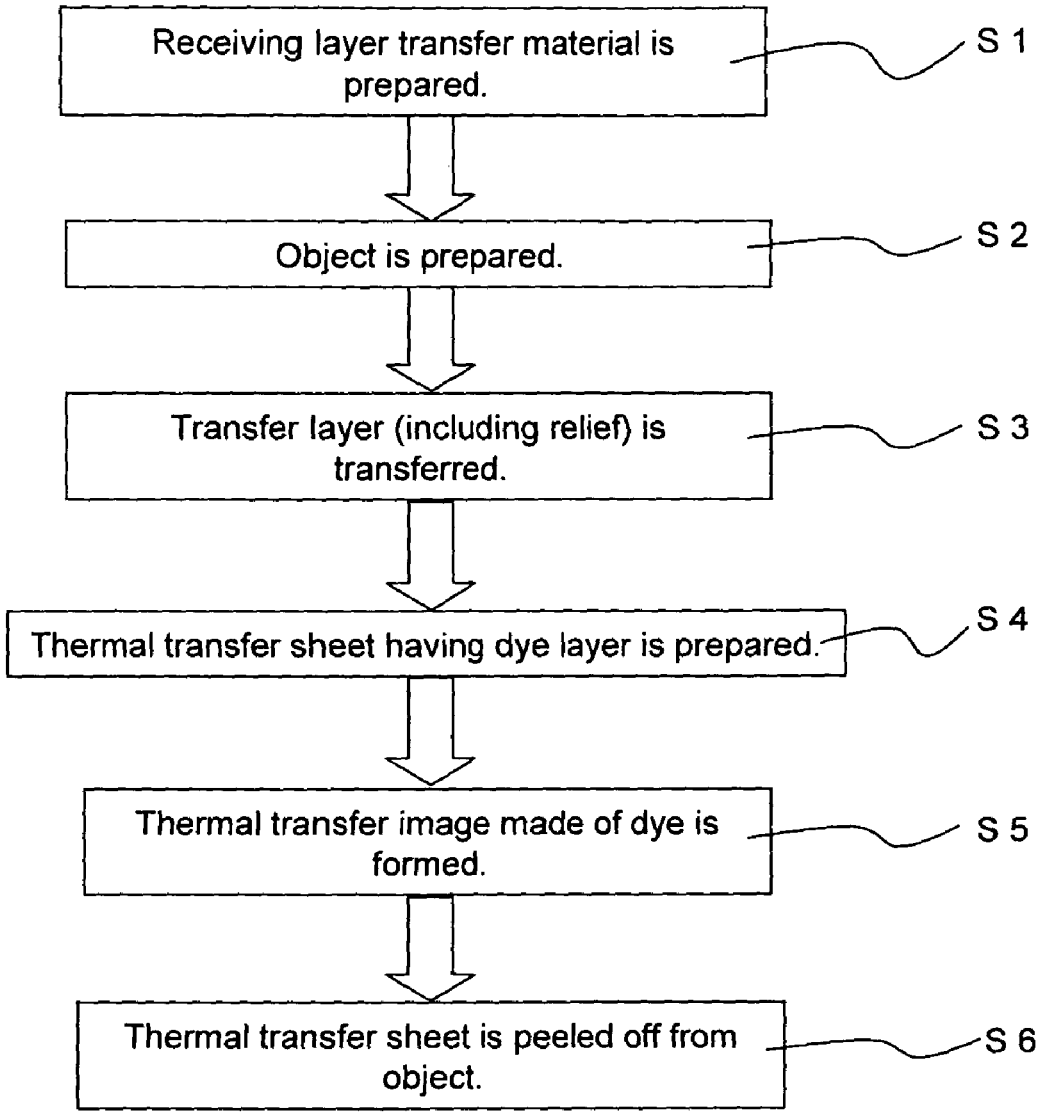
FIG. 4 is a flow chart showing an image forming method according to the present invention.

FIG. 4 shows an exemplary flow of the image forming method according to the present invention. As shown in FIG. 4, it comprises: Step 1 (*a*) which is a process of preparing the receiving layer transfer material provided with the substrate, the release layer, the dye receiving layer as the colorant receiving layer, the relief forming layer, the reflection layer and the adhesive layer in this order; Step 2 (*b*) which is a process of preparing an object; Step 3 (*c*) which is a process of transferring a transfer layer, which is a laminated structure of the dye receiving layer, the relief forming layer, the reflection layer and the adhesive layer, onto the object, in such a manner that the adhesive layer of the receiving layer transfer material is overlapped on the object; Step 4 (*d*) which is a process of preparing a thermal transfer sheet having a dye layer containing sublimation dye; Step 5 (*e*) which is a process of forming an image by overlapping the dye layer of the thermal transfer sheet on the exposed surface of the transfer layer, heating the thermal transfer sheet so that the thermoplastic resin of the transfer layer receives the sublimation dye; and Step 6 (*f*) which is a process of peeling off the thermal transfer sheet from the object.

In Step 1 (*a*) which is a process of preparing the receiving layer transfer material provided with the substrate, the release layer, the dye receiving layer as the colorant receiving layer, the relief forming layer, the reflection layer and the adhesive layer in this order, the above mentioned receiving layer transfer material is prepared. The preparation of the receiving layer transfer material is omitted, since it has been described in the explanation of the receiving layer transfer material.

In Step 2 (*b*) which is a process of preparing an object, a medium as the object is not limited to any special one, but may be natural fiber paper, coated paper, tracing paper, plastic film which does not deform by heat when transferring, glass, metal, ceramics, wood, cloth and so on. The shape and usage of the object is not limited to any special one. The examples of them include cash vouchers such as stock certificates, securities, bonds, gift certificates, checks, bills, entrance tickets, passbooks, transport tickets, riding tickets, stamps, postal stamps, viewing tickets and other tickets; cards such as cash cards, credit cards, ID cards, prepaid cards, members cards, IC cards and optical cards; greeting cards; post cards; business cards; ID photos of various IDs such as drivers licenses and passports; wrapping material such as cartons, cases and soft packages; bags; forms; envelops; tags; OHP sheets; slide films; bookmarks; books; magazines; calendars; posters; pamphlets; print club (registered trademark); menus; passports; POP products; coasters; displays; name plates; keyboards; cosmetics; accessories such as list watch and cigarette lighter; stationeries such as writing materials and report papers; architectural materials; panels; emblem; keys; fabrics; clothing; footwear; radio; television; equipments such as calculators and OA equipments; various sample books; albums; computer graphic outputs; medical image outputs and so on. Furthermore, the medium may be decorated such that at least a part thereof is colored or printed, or in other ways. The printed product which may be formed by various recording methods including thermal transferring system, electrophotography system, ink jet system and so on may be used as the object.

In Step 3 (*c*) which is a process of transferring a transfer layer onto the object, the transferring is carried out onto at least one surface of the above mentioned object by using the above mentioned receiving layer transfer material. The transferring method may be any known transferring method including hot stamping with thermal stamping, whole or stripe transferring with hot roll, thermal printer with thermal printing heat (thermal head) and so on.

In Step 4 (*d*) which is a process of preparing a thermal transfer sheet having a dye layer containing sublimation dye, the thermal transfer sheet having the dye layer containing sublimation dye may be such that the dye layer is formed as a single layer on the substrate, or such that a plurality of dye layers containing a dye having a color different from other dye layers, for example yellow dye layer, magenta dye layer, cyan dye layer, black dye layer and the like, are frame-sequentially and repeatedly formed on the same surface of the same substrate. In the present invention, a thermal transfer image having full color photographic tone is preferably formed on the substrate by using at least three color or more dye layers including yellow dye layer, magenta dye layer and cyan dye layer. The thermal transfer sheet having the dye layer containing sublimation dye used herein may be any know sheet.

In Step 5 (*e*) which is a process of forming the thermal transfer image with dye on the exposed surface of the transfer layer, the thermal transfer image is formed with dye on the exposed dye receiving layer of the transfer layer transferred on the object. The thermal transfer sheet having the dye layer containing sublimation dye is overlapped on the dye receiving layer transferred on the object, and they are heated in an image pattern by the thermal head. It is also possible to form a thermal transfer image with dye by using a thermal transfer sheet for textile printing in which the dye layer is formed in pattern on the substrate and heating the entire surface or a part (designed pattern) of the sheet with water vapor, hot stamp, hot roll or the like.

(Thermal Transfer Printer for Typing)

The thermal transfer printer for typing characters which uses the sublimation type thermal transfer sheet onto the exposed transfer layer in which the dye receiving layer is exposed on the surface by transferring the receiving layer transfer material according to the present invention to the object, may be a thermal transfer printer having any known thermal head. It may be the same as a printer which is used when the transfer layer of the receiving layer transfer material is transferred onto the object. In this manner, the present invention makes it possible to form any sublimation transferring image without requiring any treatment onto the exposed dye receiving layer which is exposed on the surface of the transfer layer which is transferred onto the object (medium).

In Step 6 (*f*) which is a process of peeling off the thermal transfer sheet having the dye layer containing the sublimation dye from the object, the image forming method according to the present invention completes by peeling off the thermal transfer sheet having the dye layer containing the sublimation dye form the object, after the printing of the thermal transfer image with dye completes.

As described above, the image forming method according to the present invention makes it possible to freely combine a hologram image, which is a specific decorative image or stereoscopic image, with an image depicted by colorant, or possible to express such a combined image on-demand, by forming an on-demand print image with colorant in any pattern or shape, onto the colorant receiving layer of the transfer layer, after a hologram or diffraction grating having any pattern or shape is transferred onto the object.

(Image-Formed Object)

Figure 3A:
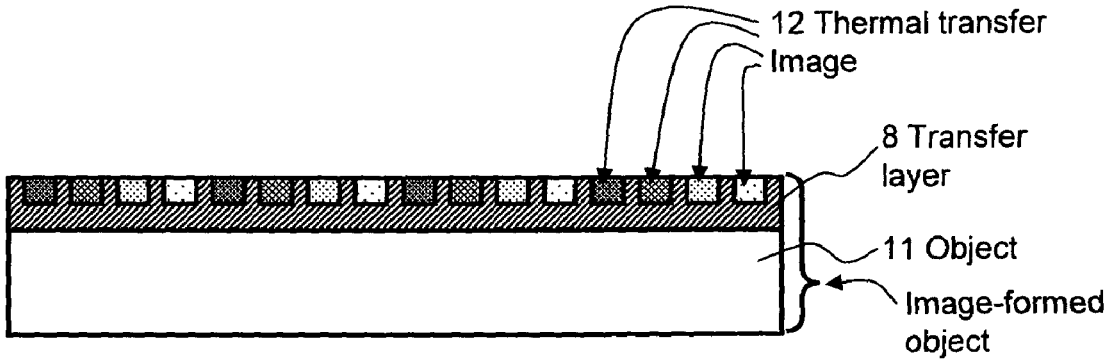
FIG. 3A is a sectional view of an image-formed object formed in the present invention.
Figure 3B:
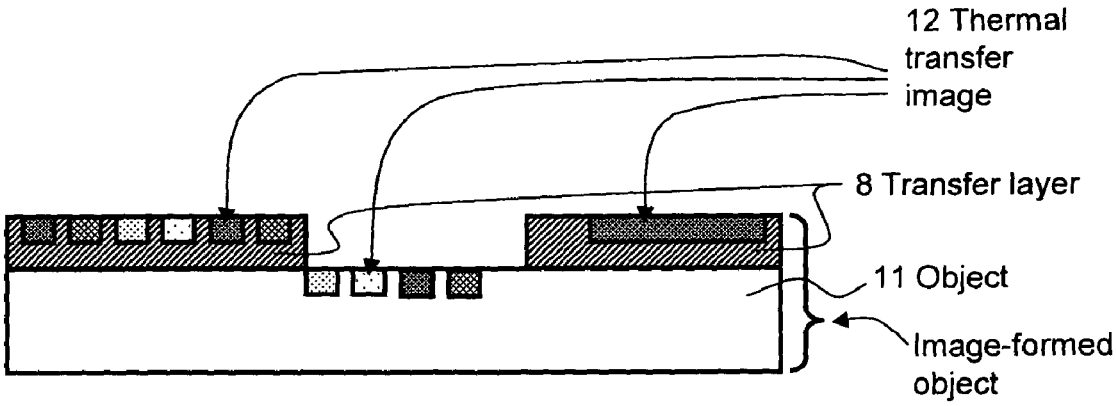
FIG. 3B is a sectional view of another image-formed object formed in the present invention.

FIG. 3A and FIG. 3B are sectional views schematically illustrating the image-formed object representing an example of the present invention. FIG. 3A and FIG. 3B shows image-formed objects according to the present invention. Onto the object (medium) 11 as an object, the transfer layer 8 is transferred. On the surface of the transfer layer 8, the dye receiving layer is exposed. The thermal transfer image 12 is formed with dye on the exposed dye receiving layer. The transfer layer 8 which is transformed by using the receiving layer transfer material comprises a laminated structure of the adhesive layer 7/the reflection layer 6/the relief forming layer 5/the anchor layer 9 (if needed)/the dye receiving layer 4. The dye receiving layer receives the dye transferred from the sublimation transfer type thermal transfer sheet. The dye received layer is dyed by the received dye, so that an image is formed.

Furthermore, as for an object already having at least the dye receiving layer 4, the relief forming layer 5 and the reflection layer 6, it is possible to obtain the image-formed object only by forming a thermal transfer image with dye onto the dye receiving layer only with a use of the thermal transfer sheet having the dye layer.

The transfer layer 8 may be a whole layer or patterned layer. FIG. 3A shows a case of forming the transfer layer 8 on an entire surface of the object 11, and FIG. 3B shows a case of forming the transfer layer 8 in a pattern on the object 11. In the case of forming the layer in a pattern, it is possible that, as shown in FIG. 3B, different thermal transfer images are formed in a plurality of transfer layers 8, or the thermal transfer images is formed in a region where the surface of the object 11 is exposed due to the lack of the transfer layer 8, by giving a dye receiving property in such a region in advance.

The transfer layer of the image-formed object obtained after thermal transferring as such has a highly designable image made of a combination of the visual effect of the relief forming layer and the image depicted with colorant(s), such as an image which is a combination of a hologram image and a thermal transfer image, or an image which is a combination of white light form the relief forming layer and a thermal transfer image. The image depicted with colorant(s) may be formed by various on-demand printing system such as ink jet system or electrophotography system, as well as thermal transfer system such as sublimation heat transfer or thermal wax transfer.

In FIG. 3A, since the transfer layer 8 of the receiving layer transfer material 1 is transferred to an entire surface of the medium 11, the relief is provided on the entire surface and the thermal transfer image 12 with dye is formed on the entire surface. In FIG. 3B, the transfer layer 8 of the receiving layer transfer material 1 is partly transferred on the medium 11, and the thermal transfer images 12 with dye are formed at the transferred portions. If the medium as the object has a dyeing property at its surface of the transfer surface, it is possible to form a thermal transfer image with dye at a portion where the transfer layer is not transferred from the receiving layer transfer material (a part where the medium 11 is exposed), although it is not shown.

As described above, the receiving layer transfer material 1 may be an entire surface transferring or may be a partial transferring such as dot or pattern. Furthermore, it may be at least two kinds of diffraction gratings each having a diffraction direction different from each other. Diffraction gratings each having a diffraction direction different from each other may use separate receiving layer transfer materials each having a diffraction direction from each other. Diffraction gratings each having a diffraction direction different from each other may be disposed randomly or regularly on one receiving layer transfer material. Dot transferring makes it possible to obtain a special design effect such as lame effect.

The image to be formed on the dye receiving layer by means of the sublimation transfer type thermal transfer sheet (thermal transfer sheet having the dye layer containing the sublimation dye) may be any of letter, mark, illustration, facial portrait, pattern and so on. Furthermore, it is possible to obtain various design effects by a combination with hologram or diffraction grating.

Furthermore, the security can be improved, since the image information of the thermal transfer image with dye formed on the hologram image is also removed away, in a case that the hologram image is tried to be removed away for a falsification purpose. Thus, the image-formed object according to the present invention is a combination of (i) a hologram or diffraction grating having various colors and (ii) a thermal transfer image with freely selected dye. The individual information can be generated on-demand, if needed, by a thermal transfer printer.

(Invention of Transfer Sheet)

Figure 6A:
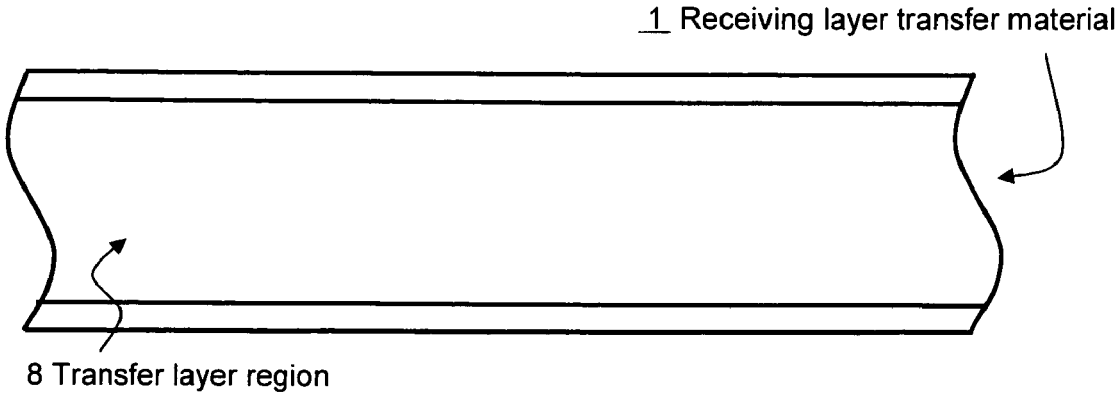
FIG. 6A is a plan view of a receiving layer transfer material according to the present invention.
Figure 6B:
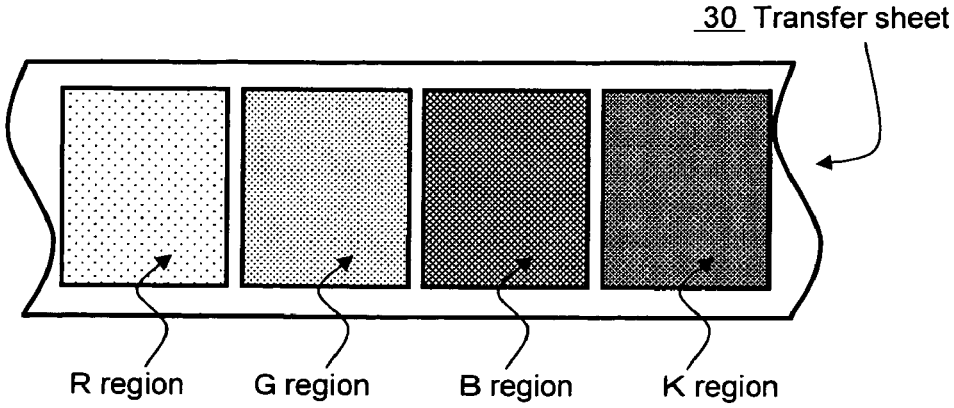
FIG. 6B is a plan view of a transfer sheet to be used in a combination with a receiving layer transfer material according to the present invention.
Figure 6C:
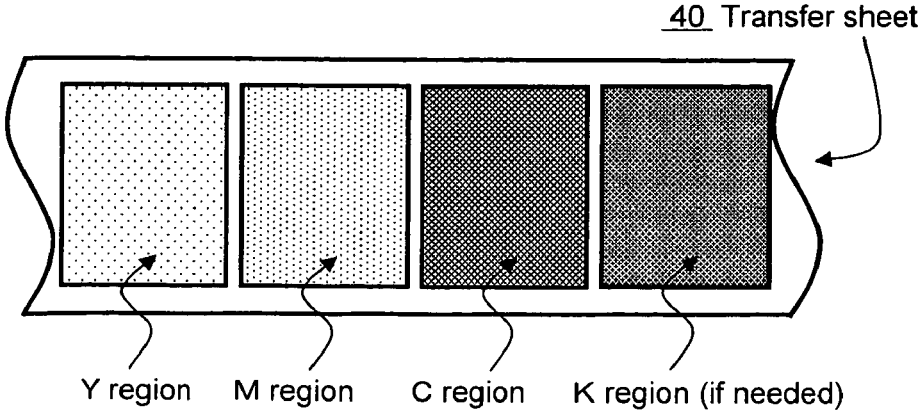
FIG. 6C is a plan view of another transfer sheet to be used in a combination with a receiving layer transfer material according to the present invention.
Figure 8:
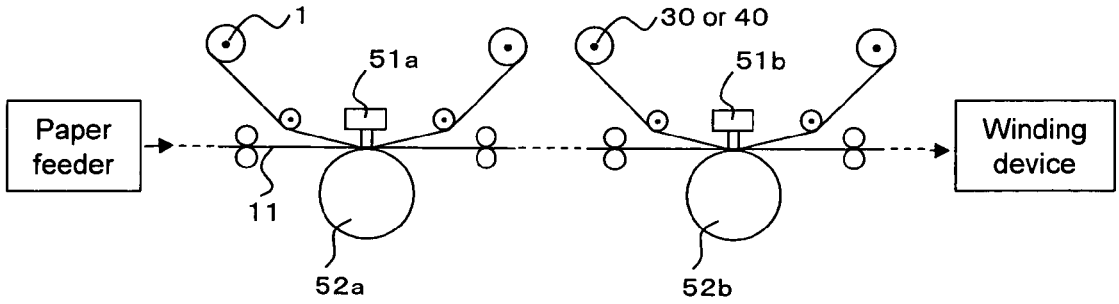
FIG. 8 is an example of a construction of a 2-head type printer to be used in the present invention.

The receiving layer transfer material 1 and the transfer sheets 30, 40, which are used for producing the image-formed object according to the present invention are illustrated in FIG. 6A to FIG. 6C. FIG. 6A shows the receiving layer transfer material 1. Although the transfer layer 8 is depicted as stripe pattern for a purpose of explanation, it may be extended on an entire surface. FIG. 6B shows a RGB transfer sheet 30 having R region, G region, B region and K region. FIG. 6C shows a YMC transfer sheet 40 having Y region, M region, C region and if needed, K region. In the case to use the receiving layer transfer material 1 with the RGB transfer sheet 30 or YMC transfer sheet 40, transferring and printing can be performed by a 2-head printer as shown in FIG. 8. In the 2-head printer, the printing on object 11 can be performed by setting the receiving layer transfer material 1 at a first head unit provided with a printer head 51*a* and a platen roller 52*a*, and setting the RGB transfer sheet 30 or YMC transfer sheet 40 at a second head unit provided with a printer head 51*b* and a platen roller 52*b*. Herein, the RGB transfer sheet 30 and the YMC transfer sheet 40 are generally referred to as the thermal transfer sheet having the dye layer.

Figure 5A:
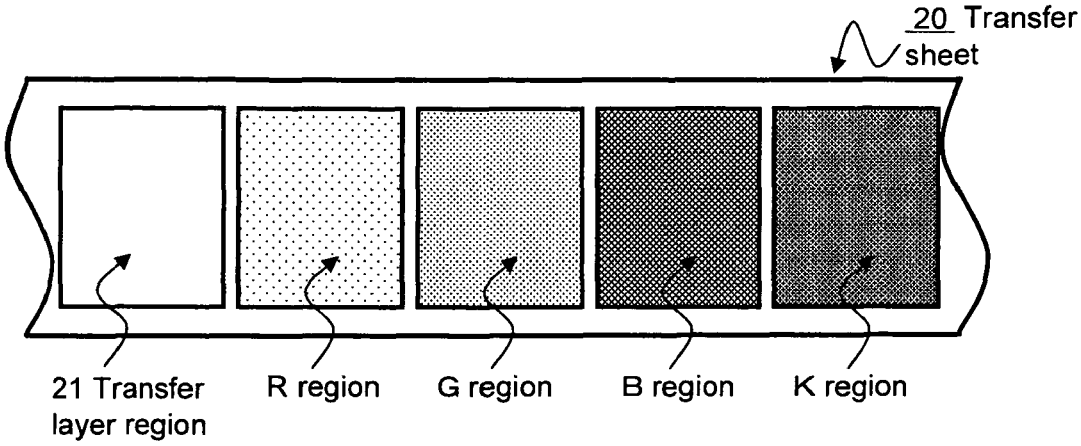
FIG. 5A is a plan view of a transfer sheet according to the present invention.
Figure 5B:
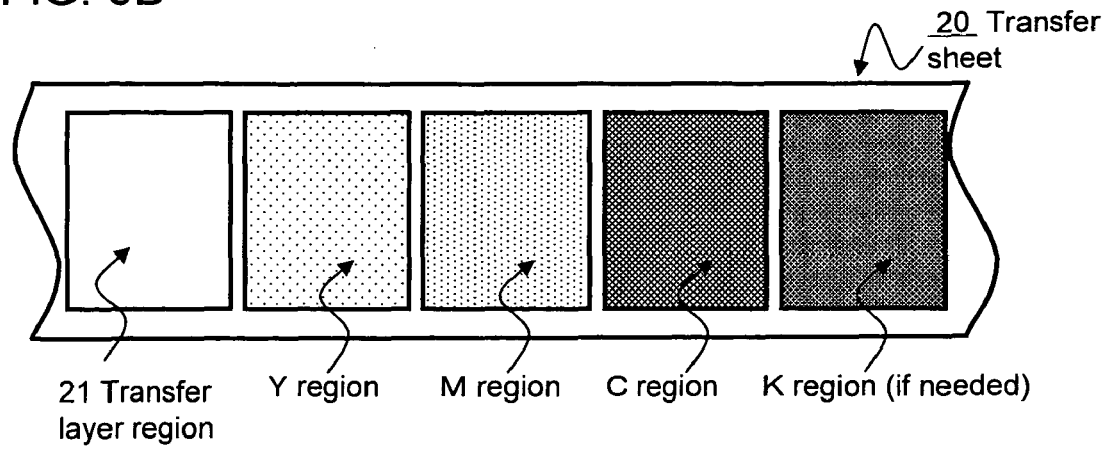
FIG. 5B is a plan view of another transfer sheet according to the present invention.

However, since the thermal transfer image is formed by means of two ribbons: a ribbon of the receiving layer transfer material 1; and a ribbon of the thermal transfer sheet having the dye layer, two or more operations are required in a 1-head printer, or the 2-head printer is required. In view of this, the receiving layer transfer material 1 and the thermal transfer sheet having the dye layer are formed on the common substrate, which is shown in FIG. 5A and FIG. 5B as the transfer sheet 20, and can be used at the 1-head printer.

By using the transfer sheet 20, it is possible to obtain one full color printed object by one step process after the transfer layer is transferred. Thereby, time for transferring and printing can be remarkably reduced. Furthermore, the limitation due to ink ribbon is reduced, and an image having a large image area can be easily printed without wasting the margin part of the ink ribbon, by synchronizing the size of the image area to be obtained with a size of the coating region of the ink layer.

Now, the construction of layers and regions of the transfer sheet 20 will be explained.

The transfer sheet 20 is provided with: a common substrate; and a transfer layer region in which a release layer 3/a colorant receiving layer 4/an anchor layer 9 (if needed)/a relief forming layer 5/a reflection layer 6/an adhesive layer 7 of the receiving layer transfer material are sequentially laminated (stacked) on one surface of the common substrate; and one or more regions containing dye as colorant. The color of one or more regions containing dye is not limited to any special one, and may be any desired color. Nevertheless, it preferably includes three primary colors for printing a full color image.

Figure 7:
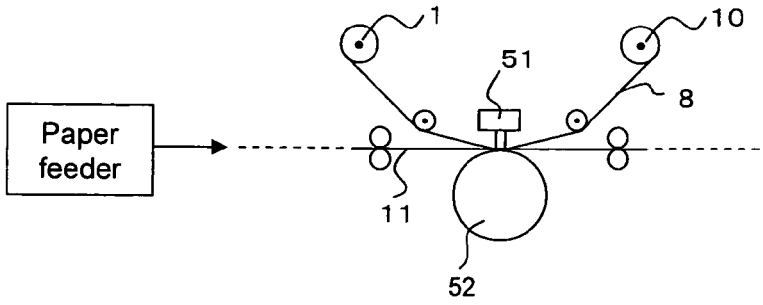
FIG. 7 is an example of a construction of a 1-head type printer to be used in the present invention.

The transfer sheet may be an RGB transfer sheet, shown in FIG. 5A, having a transfer layer region, an R region, a G region, a B region and a K region, or may be a YMC transfer sheet, shown in FIG. 5B, having a transfer layer region, a Y region, a M region, a C region, and if needed a K region. The transfer sheet 20 means both type of transfer sheets. In the case to use the transfer sheet 20, transferring and printing can be performed by using such a 1-head printer as shown in FIG. 7. In the 1-head printer shown in FIG. 7, the transferring from the transfer layer region and the printing from each region of RGBK or YMCK can be performed by setting the transfer sheet 20 at a head unit provided with a printer head 51 and a platen roller 52, and feeding the object 11.

Furthermore, the RGB transfer sheet preferably includes the K region in order to express black color. In the YMC transfer sheet, although black color can be expressed by YMC, the K region may be included in order to emphasizing black color or contrast.

Furthermore, the transfer sheet 20 such as the RGB transfer sheet and the YMC transfer sheet may include other region such as a special color region or protection layer region, besides one set of 5 or 4 regions. In fact, it is sufficient that one set of at least 5 or 4 colors is disposed repeatedly.

Only the region structures of the colorant layer and dyes are different among the RGB transfer sheet 30 shown in FIG. 6 and the YMC transfer sheet 40 shown in FIG. 6C, which require the 2-head printer, and the RGB transfer sheet shown in FIG. 5A and YMC transfer sheet shown in FIG. 5B, which are suitable for the-head printer. Therefore, since the former two sheets can be understood by applying their region structures and dyes in the explanation of the latter two sheets, the explanation will be made on only the transfer sheet 20 such as the RGB and YMC transfer sheets having more elements.

(RGB Transfer Sheet)

The RGB transfer sheet 20 is provided with a substrate and five regions including: a transfer layer region in which a release layer, a dye receiving layer or other colorant receiving layers, a relief forming layer, a reflection layer and an adhesive layer are sequentially laminated on one surface of the substrate; an R region; a G region; a B region and a K region. As shown in FIG. 5A, one set of five regions is repeatedly disposed. By using the RGBK regions and the RGB transfer sheet having the transfer layer, and by performing the transfer in such a manner that each dot of R, G and B is not overlapped on each other, the light beam which is whitely reflected becomes a light source, and the RGB transfer pattern acts like as a color filter of the reflection type liquid crystal. Therefore, it is possible to reproduce and print freely by a printer a still image itself of the reflection type liquid crystal display apparatus basically according to an additive process. Three dots of RGB cannot express black. Therefore, the K region may be further provided, besides RGB regions. Relating to this, the image information of K is the K information when used in a YMCK system. In this case, since one color is reproduced by three dots of R, G and B, the resolution is lowered by the general sublimation heat transfer of YMC. However, this problem can be solved by improving the resolution of the printer. In the reflection type liquid crystal, the black color is expressed by switching a electrical signal ON-OFF to shutout the light. In the present invention, the block color can be expressed by providing the K region.

The image obtained as such from (i) white diffusion light from the relief forming layer 5 or white reflection light into a specific angle range, and (ii) a thermal transfer image has a very high designability. This image can be full-colored, and has a good visibility regardless of the observation points, and has a good color reproducibility even in the observation at an observation point in the wide range, and the image is natural without losing a color balance. Furthermore, the color reproducibility is good even in the case that the under color is changed. Furthermore, the image can be produced easily by using an existing equipment, and transferring and printing of the thermal transfer image can be achieved by an existing printer.

The image according to the present invention is advantageous in the above mentioned points, even in comparison with a conventional full color image which is formed by using a thermal transfer sheet using three kinds of OVD designed so that the observed color has a spatial frequency adapted to be any of three primary colors of RGB at a special observation point, to form a dot image in a dot shape having a fine area onto the object by the thermal head. In any case, the reflection type liquid crystal image can be reproduced by an additive process, and the accurate color reproduction can be achieved, and not limited to any special observation direction.

(YMC Transfer Sheet)

The YMC transfer sheet 20 is provided with four or five regions including: a transfer layer region; a Y region; an M region; a C region and if needed, a K region. One set of four or five regions is repeatedly disposed. The K region is not necessary, since the block color can be expressed by YMC. However, the K region may be provided, for example in order to emphasize the block color or contrast. Therefore, it is possible to reproduce and print freely by a printer a still image itself of the reflection type liquid crystal basically, even in the case of using YMC regions and if needed the K region, as well as the YMC transfer sheet having the transfer layer. The image is printed on the transfer layer 8 (having a white reflection board function), so that a high designable image is obtained. The Y region, the M region, the C region and the K region may be of the same materials or composition as other regions each containing dye, except that the used dye is different.

(Transfer Sheet Having Dye Layer)

The transfer sheet 30 or 40 having the dye layer which does not contain the transfer layer 8 may be preferably a textile printing sheet containing sublimation dye or a sublimation transfer type ink ribbon. The dye layer may be disposed over an entire surface or may be provided partly. The color tone is not limited and may be for single color, multi-color or full color. The sublimation transfer type ink ribbon is preferable, in view of the on-demand printability.

(Sublimation Transfer Type Ink Ribbon)

The sublimation transfer type ink ribbon is provided with: a substrate sheet; a thermal sublimation ink layer on one surface of the substrate; and optionally a heat resistant smooth layer on another surface of the substrate sheet. The material of the substrate sheet may be polyethylene terephthalate, polybutylene terephthalate, polyethylene naphthalate and so on, which have a good compatibility with the printing machine, and a good mechanical strength and good heat resistance for withstanding the heat during the thermal transfer. Among them, polyethylene terephthalate is optimum. Thickness of the substrate sheet nay be usually about 2.5~100 μm, preferably 2.5~25 μm, and optimally 2.5~12 μm.

(Thermal Sublimation Ink Layer)

The thermal sublimation ink is obtained by containing sublimation dye and pigment in binder. The ink is formed into a thickness of about 0.2~5.0μ. The dye for this thermal sublimation transfer layer is preferably disperse dye, having a molecular weight of about 150~500. The dye can be selected in view of its thermal sublimation temperature, color phase or hue, weather resistance, stability in binder, and so on. Specific examples will be described as follows.

(Dye for Thermal Sublimation Ink)

The yellow dye may be Phorone Brilliant Yellow S-6 GL or the like, the red dye may be MS red or the like, and the blue dye may be Kayaset Blue 14 or the like. Furthermore, it is possible to form a black or any other colored dye layer by mixing the above sublimation dye of each color. Depending on the sublimation temperature of the dye or the covering power intensity of the dye in its developed state, the dye is contained at about 5~70 wt. %, preferably 10~60 wt. %, in the thermal sublimation transfer layer.

(Binder for Thermal Sublimation Ink)

The resin to be used for binder is usually selected from resins which have high heat resistance, and do not prevent the dye transfer when heated. Examples include: cellulose resins such as ethylcellulose or cellulose acetate butyrate; and vinyl resins such as polyvinyl alcohol, polyvinyl butyral, polyvinyl pyrolidone, polyvinyl acetal; or polyester; polyacrylamide and so on.

(Formation of Dye Ink Layer)

The thermal ink layer is formed by dispersing or dissolving the above mentioned dye, pigment, and optionally various additives, into binder and solvent, then coating the liquid onto the substrate sheet and then drying the coated liquid. The coating method may be known coating method such as gravure coating, gravure reverse coating, roll coating, or silk screen printing, offset printing, gravure printing, gravure offset printing and so on. Thickness of the thermal sublimation ink layer may be determined so that the concentration required for the printed image is balanced with the thermal sensitivity. Thickness is in a range of 0.1~30 μm, and preferably 0.2~10 μm.

The thermal sublimation ink layer can be formed by repeating the number of colors. In the case of yellow, magenta and cyan, for example, each color is printed. The material and making method of the heat resistant smooth layer may be the same as in the case of the heat resistant smooth layer of the transfer foil.

(Image Forming Method)

Then, the image is formed on the transfer layer 8. The image is formed by superimposing the transfer sheet 30, 40 containing dye on the exposed surface of the transfer layer 8 which are transferred on the object 100, and printing with a means such as heating and pressurizing device. The heating and pressurizing can be achieved by forming an image by using a thermal printer, in the case of sublimation transfer type ink ribbon.

(Thermal Printer)

The thermal printer is provided with: thermal printer head (also referred to as thermal head or printer head); and a platen roller which is opposed to the thermal printer head. Between the thermal printer head and the platen roller, the thermal transfer sheet (also referred to as ink ribbon) provided with the thermal sublimation ink layer is sandwiched with the object. They are compressed against the thermal head by the rolling platen roller, and run according to the rolling. The thermal sublimation ink layer of the ink ribbon faces with the object.

(Thermal Head)

Then, heating elements of the thermal head is heated according to the image. The selectively heated transfer dye in the ink ribbon is transferred onto the object in a dot pattern, so that a predetermined image is formed (also referred to as printed). Printing system includes serial system and line system. The thermal head may be laser heat mode thermal head, light and thermal recording head, thermal head so on, but not limited to any special one. The resolution of the thermal head is not limited to any special value, but may be 100~600 dpi, for example. In this way, the present invention makes it possible to form any sublimation transferred image on the dye receiving layer which is exposed on the surface of the transfer layer which is transferred onto the object, without any special treatment.

Now, each operation of the image forming method, and material to be used will be explained.

(Transferring of Transfer Layer)

The method for transferring the transfer layer to the object 11 may be any known transferring method, such as hot stamping with thermal stamping (haku-oshi), whole or stripe transferring with hot roll, thermal printer with thermal head (thermal printer head) and so on. Thermal printer is preferable.

(Pattern of Transfer Layer)

The pattern of the transfer layer to be transferred onto the object may be a pattern such as rectangle, circle or star shape, or stripe shape, or whole solid shape, and not limited to any special one. In the case of the pattern or stripe shape, there may be a plurality of them. The method for transferring them can be suitably selected from the above mentioned, for example, hot stamping with thermal stamping (haku-oshi), whole or stripe transferring with hot roll, thermal printer with thermal head (thermal printer head) and so on.

(Pattern of Thermal Transfer Image)

As for the thermal transfer image, since a predetermined dot image is formed (also referred to as printed) by using the thermal printer (also referred to as thermal transfer printer) as mentioned above, any image is formed by sublimation transferring. Particularly, printing a color picture is effective. Nevertheless, one or more color may be applicable, and the image may be without any limitation letter, numeral, illustration and so on. It is also possible to obtain a special designability and security by transferring the transfer layer 8 (colorant receiving layer 4) as a pattern on a surface of the object, and forming a thermal transfer image both on a part of the surface of the object where the transfer layer 8 (colorant receiving layer 4) is not transferred and on the transfer layer 8 (colorant receiving layer 4) transferred on the surface of the object.

(Object)

Object 11 is not limited to any special one, but may be natural fiber paper, coated paper, tracing paper, plastic film which does not deform by heat when transferring, glass, metal, ceramics, wood, cloth or medium having a dye receiving property. The shape of the object is not limited to any special one. The examples of them include cash vouchers such as certificates and tickets; cards or ledger sheets such as credit cards, prepaid cards, greeting cards, drivers licenses, IC cards and optical cards, cases or wrapping materials such as cartons; sheets or POP products such as tags, bookmarks and posters; cosmetics; accessories such as list watch and cigarette lighter; stationeries such as report papers and envelopes; architectural materials; panels; emblem; keys; fabrics; clothing; footwear; bags; equipments such as television, calculators and OA equipments; and so on. The medium as the object 11 may be at least partly colored, printed or decorated in other ways, and/or other layer such as primer layer, adhesive layer and protective layer may be disposed on the surface or between layers.

(Image Forming Method)

The image forming method according to the present invention includes (1) a 1-head-1-path method using the transfer sheet 20 as shown in FIG. 5A and FIG. 5B having the transfer layer region including the colorant receiving layer and the relief layer, and the colorant layer region, (2) a 1-head-2-path method or 2-head-1-path method using the thermal transfer sheet 30 or 40 as shown in FIG. 6B or 6C which has no transfer layer although has the colorant layer region in combination with the receiving layer transfer material 1 according to the present invention. Herein, "head" means a printer head, but abbreviated just as "head".

(1-Head-1-Path Method)

The 1-head-1-path method makes it possible to obtain an image having a thermal transfer image and a visual effect due to the relief forming layer by 1-run operation with using the transfer sheet 20 as shown in FIGS. 5A and 5B.

Specifically, (1) preparing the transfer sheet 20 as shown in FIGS. 5A and 5B, (2) preparing an object, (3) transferring the transfer sheet onto the object, (4) continuously keeping printing the thermal transfer image. In fact, it is a 1-path method (also referred to as 1-head printer, 1-ribbon, 1-path (1 cycle) method) in which 2-runs: one is the transfer operation of the transfer layer onto the object with using the transfer sheet 20 (1 ribbon); another is the printing operation of the thermal transfer image onto the colorant receiving layer of the transfer layer, are repeated by the same thermal head. The 1-head-1-path method has a long printing time, and requires a high cost and high technology for producing the transfer sheet material. However, in this method, devices for transferring and printing are simple, low cost and easy to operate.

(1-Head-2-Path Method)

The 1-head-2-path method makes it possible to obtain an image made of a thermal transfer image and a visual effect due to the relief forming layer, via 2-run operations: firstly, (1) running an operation for transferring the transfer layer onto the object by using the receiving layer transfer material which has no colorant layer, and then (2) printing the thermal transfer image on the colorant receiving layer of the transfer layer on the object, with using a transfer sheet in which at least one set of four regions including a region containing red dye, a region containing green dye, a region containing blue dye and a region containing black dye is disposed repeatedly on one surface of the substrate, or a transfer sheet in which at least one set of three regions including a region containing yellow dye, a region containing magenta dye and a region containing cyan dye is disposed repeatedly on one surface of the substrate. That is, by a method that those skilled in the art refers to as 1-head printer, 2-ribbon, 2-path (2 cycles), an operation for transferring the transfer layer and an operation for printing the thermal transfer image are run in two times, respectively.

Specifically, (1) preparing the receiving layer transfer material 10 (mentioned above), (2) preparing an object, (3) superimposing the adhesive layer of the receiving layer transfer material 10 on the object, and transferring the transfer layer onto the object, (4) preparing the thermal transfer sheet having the dye layer, (5) superimposing the thermal transfer layer on the exposed surface of the transfer layer on the object, so that the transfer layer receives the dye to form an image. In fact, two operations are required in order to transfer the transfer layer to the object, and in order to print (transfer) the thermal transfer image to the transfer layer. Printing the thermal transfer image is repeated sufficiently four times in the case of the transfer sheet having RGBK regions, or three times in the case of the transfer sheet having YMC regions.

(2-Head-1-Path Method)

The 2-head-1-path method performs continuously the following two operations in one time runs: (1) an operation for transferring the transferring layer on the object, and (2) an operation for printing the thermal transfer image onto the colorant receiving layer of the transfer layer. By a method that those skilled in the art refers to as 2-head printer, 2-ribbon, 1-path method, two operations are performed continuously in one run with a printer device having two printer heads. The image printing conventional in the art and the high designable image printing according to the present invention can be performed in the same printer.

The 2-head-1-path method makes it possible to obtain a high designable full color image via one run (1 path) with two printer heads by using two ribbons: one is the receiving layer transfer material 1 (also referred to as receiving layer transfer ribbon), and another is the transfer sheet (also referred to as sublimation transfer ribbon) having RGBK regions or YMC regions.

Two ribbons which are the receiving layer transfer material 1 (also referred to as receiving layer transfer ribbon) and the transfer sheet (also referred to as sublimation transfer ribbon) having RGBK regions or YMC regions are exclusive ribbons for transferring the transfer layer, or transferring the thermal transfer image, respectively. They has a good reproducibility of color tone, and easy to be produced with low cost. The transfer sheet (also referred to as sublimation transfer ribbon) having RGBK regions or YMC regions may be a known ribbon which is referred to as sublimation transfer ink ribbon.

In the 2-head-1-path method, there is no need to separately provide a device for obtaining a high designable image print according to the present invention and a device for obtaining a conventional image print. Thereby, the installation cost is low.

Also in the 1-head-2-path method, it is possible to obtain a high designable image having a good reproducibility of color tone, and use the same transfer sheet, except that the run (path) is twice.

Modified Embodiment 1

The present invention includes a modified embodiment which will be explained below.

(Object with Visual Effect)

The present invention can be implemented by providing, in advance, a visual effect such as hologram function or white reflection function and the colorant receiving layer on the object, and forming the thermal transfer image with the thermal transfer image having the dye layer. The visual effect may be provided by transferring, in advance, the transfer layer 8 of the receiving layer transfer material 1 according to the present invention onto the object, or by forming another relief structure on the object, for example.

Especially, in the case that the relief forming layer having a white diffusion function or white reflection function is transferred onto the object from the transfer sheet, the white reflection function may be deteriorated because of losing the reflection pattern due to heat during transferring, which is different from the case of transferring a general hologram image. In view of this, if it is desired to dispose the receiving layer having the white diffusion function or white reflection function on the object, the relief having the white diffusion function or white reflection function is preferably formed on the object, in a way other than transferring.

The transferring method may be implemented by (1) preparing an object, (2) preparing the receiving layer transfer material 1 according to the present invention, and (3) transferring the transfer layer onto the object by using the receiving layer transfer material 1. The method for providing another visual effect and colorant receiving layer may be implemented by (1) preparing an object, (2) forming a relief forming layer, (3) patterning a relief having the visual effect, (4) forming a reflection layer, and (5) forming a colorant receiving layer. Although these methods are different in forming the relief, the function is the same.

In any object, an image may be formed onto the colorant receiving layer in on-demand printing system. The image-formed object obtained as such makes it possible to obtain a highly designable image which is a combination of the visual effect due to the relief forming layer and the colorant.

The object (the colorant receiving sheet with the relief layer) used in this case may have a structure in which (i) the relief forming layer is provided on one side of the substrate, the relief forming layer being provided with the reflection layer on the relief forming side and having the visual effect, and (ii) the colorant receiving layer is provided on more surface side than the relief forming layer or on an opposite side of the side of the substrate where the relief forming layer is formed.

The object may have the structure in which the relief forming layer with the reflection layer, and the colorant receiving layer are laminated in this order on one side of the substrate, or may have the structure in which the relief layer with the reflection layer is formed on one side of the substrate, and the colorant receiving layer is formed on another side of the substrate. The relief forming surface of the relief forming layer may face to the substrate, or may face to a front surface or rear surface of the object. To the object, any other layers may be added, such as an anchor layer to be formed between the colorant receiving layer and the relief forming layer.

In the case that the object is an object in which the relief forming layer 5 having the visual effect, the reflection layer 6 and the colorant receiving layer 4 are sequentially formed at least in advance, the reflection layer 6, the relief forming layer 5 having the visual effect and the colorant receiving layer 4 are sequentially formed on the object 11.

The material and forming method of the colorant receiving layer 4, the relief forming layer 5 having the visual effect and the reflection layer 6, and the relief patterning method may be the same as in the case of the receiving layer transfer material 1. For example, the relief forming layer 5 is formed by coating a relief forming resin of 0.5 to 2 g/m$^2$ on the dried basis onto the object, and then the relief (e.g. having the white reflection function) is patterned and cured by UV irradiation. Then, similarly to the above case, the reflection layer 6, and the colorant receiving layer 4 containing thermoplastic resin and release agent are formed. The layered structure is the relief forming layer 5/the reflection layer 6/the colorant receiving layer 4, which is different from the layered structure of the receiving layer transfer material in its sequential order, but is the same in its effect. The adhesive layer 7 and the anchor layer 9 may be provided, if needed.

The transfer image may be formed onto the colorant receiving layer with a use of the known transfer sheet 30, 40 which is low price and has the dye receiving layer which has RGBK regions, or YMC regions.

(Ink Jet Printing)

In this case, printing may be implemented by ink jet printing, instead of thermal transfer with a use of the thermal transfer sheet having the dye layer. The receiving layer in this case may be, for example, polyolefin resin such as polypropylene; halogenated resin such as polyvinyl chloride or polyvinylidene chloride; vinyl resin such as polyvinyl acetate, vinyl chloride-vinyl acetate copolymer, ethylene-vinyl acetate copolymer or polyacrylic ester; polyester resin such as polyethylene terephthalate or polybutylene terephthalate; polystyrene resins; polyamide resin; copolymer resin of olefin such as ethylene or propylene with other vinyl polymer; cellulose resin such as ionomer or cellulose diastase; polycarbonate and so on. Particularly, vinyl chloride resin, acrylstyrene resin or polyester resin is preferable.

The receiving layer can be formed by dissolving or dispersing one or more materials selected from the above listed materials, and various additives if needed, into an appropriate solvent such as water or organic solvent to obtain a dye receiving layer coating liquid, then coating and drying this liquid by gravure printing, screen printing or reverse coating with gravure plate. The thickness of the receiving layer is about 1~10 μm on the dried basis.

Modified Embodiment 2

The present invention includes a modified embodiment which will be explained below.

In the present invention, it is possible to use an image receiving paper as an object in which the dye receiving layer is provided in advance. It is possible to provide the visual effect and the thermal transfer image to the image receiving paper by using the receiving layer transfer material 1 according to the present invention and the thermal transfer sheet having the dye layer. In this case, it is possible to produce the image-formed object in which the image with the colorant is formed on the receiving layer of the transfer layer and the receiving layer of the image receiving paper, respectively, as shown in FIG. 3B.

Specifically, (1) preparing an image receiving paper as an object, (2) preparing a receiving layer transfer material 1, (3) superimposing an adhesive layer of the receiving layer transfer material 1 onto the object, and transferring the transfer layer onto the object, (4) preparing a thermal transfer sheet having a dye layer, (5) superimposing the thermal transfer sheet onto the exposed surface of the transfer layer, so that the transfer layer receives the dye to form an image. The transferring operation is not limited to any special one, but may be any of the 1-head-1-path method, the 1-head-2-path method, and the 2-head-1-path method.

The image receiving paper is not limited to any special one insofar as a layer for receiving a dye is provided. Preferably, it is an image receiving paper used for sublimation transfer, such as an image receiving paper having a structure of the receiving layer/the substrate, the receiving layer/the white primer layer/the substrate, the receiving layer/the white primer layer/the laminated substrate/the rear material.

It also may be a thermal transfer image sheet for sealing comprising a seal portion in which at least a receiving layer, a seal substrate and an adhesive layer are sequentially laminated, and a release portion provided with a release layer and a release substrate, in which the release layer is releasably laminated with the adhesive layer. The thermal transfer image sheet for sealing may be subjected to a half-cut treatment.

The release portion of the thermal transfer sheet for sealing is provided with the release substrate and the release layer. For example, the release layer having the releasability due to a known release agent such as silicone is formed on a conventionally known plastic film or on a polyethylene coated paper at its polyethylene side. The adhesive layer of the thermal transfer sheet for sealing can be formed by using conventionally known resin such as polyvinyl acetate, acrylic resin, vinylacetate copolymer, polyurethane, natural rubber, nitrile rubber, or gum dissolved in organic solvent, or adhesive dissolved or dispersed in aqueous solvent. Known method such as gravure coating, roll coating, bar coating is applicable. The coating amount is about 8 to 30 g/m$^2$ (on the solid content basis).

The seal substrate for the thermal transfer sheet for sealing may be any conventionally known substrate. The thickness of the seal substrate is preferably 10 to 50 μm, depending on its material or whether or not be oriented. If the thickness of the film is thin, the elasticity (so-called kosi) is so insufficient that wrinkles of the obtained thermal transfer sheet for sealing may be caused due to heat shrinkage during the image forming with thermal head. If the thickness of the film is thick, the heat set curl is likely to be caused by heat of the thermal head during the image forming. It is also preferable to use a seal substrate provided with: a resin film having no microvoid inside thereof contacting with the adhesive layer; and a resin film having microvoids inside thereof contacting with the receiving layer. This arrangement makes it possible to form an image having an improved colority of the high concentration part and having a high quality. It is also possible to laminate the film having microvoids and the film having no microvoid in order to use as the seal substrate.

The receiving layer of the thermal transfer sheet for sealing may be disposed directly on the substrate, or via the primer layer. The receiving layer has a function for receiving the colorant transferred from the thermal transfer sheet by heat. In the case of sublimation dye, it is desired that the colorant layer is received and colored, and the dye once received is prevented from being re-sublimated. The receiving layer include thermoplastic resin as its main component such as ethylene-vinyl copolymer, copolymer of olefin monomer or polyolefin such as polypropylene and other vinyl monomer, ionomer, cellulose derivative such as cellulose diacetate, halogenated polymer such as vinyl chloride-vinyl acetate copolymer, polyvinyl acetate, polyester such as polyacrylic ester or linear polyester, polystyrene resin, polycarbonate resin, polyamide. The thickness of the receiving layer is about 1~50 μm (solid content basis). Preferable thermoplastics are polyester, and vinyl chloride-vinyl acetate copolymer, or a mixture thereof.

In order to prevent the fusion between the thermal transfer sheet having the colorant transfer layer and the receiving layer of the thermal transfer sheet for sealing, or prevent the lowering of the printing sensitivity during the image forming, it is possible to add the release agent to the receiving layer or to coat the release agent on the surface of the receiving layer. Also, in order to improve of whiteness of the receiving layer to improve the visibility of the transfer image, it is possible to add white pigment, fluorescent brightener or the like to the receiving layer, or provide an antistatic layer, if needed. The detail is disclosed by the commonly assigned, Japanese Patent Application No. 2000-301843.

The method may be the 1-head-1-path method in which the transfer layer 8 and the transfer image are transferred and printed onto the receiving paper by using one ribbon of the transfer sheet 20 according to the present invention or may be the 1-head-2-path method or 2-head-1-path method in which the transfer layer 8 having the visual effect is transferred onto the receiving paper by using two ribbons: a ribbon of the receiving layer transfer material 1 and a ribbon of the thermal transfer sheet 30 or 40 having the dye layer, and further the transfer image is printed by using the thermal transfer sheet 30 or 40 having the dye layer.

For example, in the printer device of 2-head-1-path method, the receiving layer transfer material 10 according to the present invention is loaded at the first head position 1, and the thermal transfer sheet 30 or 40 having the dye layer at the second head portion. The image-formed object has a high designable image provided with the visual effect due to the relief forming layer and the thermal transfer image by (1) printing an image made of general colorant by using only the thermal transfer sheet 30 or 40 having the dye layer at the second head portion, and (2) transferring the transfer layer 8 at the first head portion and then printing the thermal transfer image by using thermal transfer sheet 30 or 40 having the dye layer at the second head portion.

Thus, it is possible to perform the conventional image printing and the image printing of the highly designable image according to the present invention at the same printer device. Therefore, the installation cost is low, since there is no need to separately install a device for obtaining the conventional image print and a device for obtaining a highly designable image print according to the present invention.

It is also possible to use the 1-head-1-path method using the transfer sheet 1 according to the present invention in order to perform the conventional image printing and the highly designable image printing according to the present invention at the same printer device. However, it may be selected depending on frequency of the image output, in view of a fact that a relatively expensive transfer layer 8 is wasted without being used during the conventional image printing, although the printer device is low cost because of its simple construction.

(Image)

As described above, even if an image is printed after the transfer layer is transferred, by any of the 1-head-1-path method, the 1-head-2-path method, 2-head-1-path method or a method for providing the transfer layer in advance and then printing an image, the obtained image in any case has the visual effect due to the relief forming layer 5 and the image formed in on-demand system, and has the same high designability, as described above.

(Image-Formed Object)

As described above, as for the image-formed object according to the present invention, the transfer layer 8 provided with the adhesive layer 7/the reflection layer 6/the relief forming layer 5/the anchor layer 9 (if needed)/the colorant receiving layer 4 in this order is transferred onto the object 11, and then the transfer image made of colorant is formed at the transferred colorant receiving layer 4, by using a ribbon of the receiving layer transfer material 1 according to the present invention and a ribbon of the transfer sheet 30 or 40 having the colorant layer, or using the transfer sheet 20 according to the present invention, in an image forming method such as the 1-head-1-path method, the 1-head-2-path method and the 2-head-1-path method. Thereby, the image-formed object according to the present invention is obtained as an image-formed object having a highly designable image provided with the visual effect (e.g. white diffusion light or white reflection light into a specific angle range) due to the relief layer 5 and the transfer image represented by colorant.

In the case of object already having at least the colorant receiving layer 4, the relief forming layer 5 having the visual effect and the reflection layer 6, the image represented by colorant is formed at the colorant receiving layer 4, so that the image-formed object according the present invention having the highly designable image provided with the visual effect due to the relief layer 5 and the image represented by colorant. It is off course possible to further transfer the protective layer (OP layer).

The obtained image according to the present invention can be full-colored, and has a good visibility regardless of the observation point, and has the color reproducibility even in an observation at an observation point in a wide range, and has a natural image quality without losing color balance.

Also, in the case of printing in the conventional art, if the color of the object (underlying layer) is white when printing, the black hair part of a portrait of a person wearing black hair is not printed. Thereby, white of the underlying layer appears on the surface as if the person wears white hear, which is unnatural. In the present invention, however, there is no limitation about color of the object as underlying layer, so that the good color reproducibility is obtained even if the underlying layer changes. That is, there is no influence of the underlying color, since the relief forming layer having white diffusion function or white reflection function into a specific angle range is transformed on the underlying layer, and the thermal transfer image with dye is formed thereon. Furthermore, blackish gradation of the shadow part can be freely expressed by the thermal transfer of dye.

Furthermore, it can be produced easily by an existing equipment, and it is easy to print the thermal transfer image onto the relief forming layer/the dye receiving layer surface.

EXAMPLES

The present invention will now be further discussed, in view of Examples including A series and B series. Nevertheless, the present invention is not limited to these Examples. Examples of A series relate to the first aspect of the invention (the relief forming layer with hologram image), and Examples of B series relate to the second aspect of the invention (the relief forming layer with white reflection function).

Examples of A Series

Example A1

A polyethylene terephthalate film (product name: lumirror, Toray Industries, Inc.) having a thickness of 6 μm was used as a substrate of a receiving layer transfer material. A heat resistant smooth layer coating liquid having the following composition was coated on a rear surface of the substrate by a gravure coating, in such a manner that the coating amount on the dried state basis will be 0.10 to 1.20 g/m$^2$, and then dried to form a heat resistant smooth layer.

<Heat Resistant Smooth Layer Coating Liquid>

Polyvinyl butyral resin (product name: S-LEC BX-1, Sekisui Chemical Co., Ltd.): 13.6 parts Polyisocyanate curing agent (product name: Takenate D218, Takeda Pharmaceutical Company Limited.): 0.6 parts Phosphoric ester (product name: Plysurf A208S, Dai-Ichi Kogyo Seiyaku Co., LTD.): 0.8 parts Methyl ethyl ketone: 42.5 parts Toluene: 42.5 parts A release layer coating liquid having the following composition was coated on a surface of the substrate different from the surface where the heat resistant smooth layer was formed, by a coater, in such a manner that the thickness on the dried state basis will be 0.5 g/m$^2$, and then dried at 80° C. to form a release layer. In this specification, "part" or "parts" in the composition is based on weight, unless otherwise noted.

<Release Layer Coating Liquid>

Silicone modified acrylic resins (product name: CELTOP 226, Daicel Chemical Industries, Ltd.): 16 parts Aluminum catalyst (product name: CELTOP CAT-A, Daicel Chemical Industries, Ltd.): 3 parts Toluene/Methyl ethyl ketone (mass ratio 1/1): 16 parts A dye receiving layer coating liquid having the following composition was coated on a surface of the release layer, by a coater, in such a manner that the thickness on the dried state basis will be 0.5 to 1.0 g/m$^2$, and then dried at 80° C. to form a dye receiving layer.

<Dye Receiving Layer Coating Liquid>

Vinyl chloride-vinyl acetate copolymer (product name: SOLBIN C, Nissin Chemical Industry Co., Ltd.): 100 parts Epoxy modified silicone (product name: X-22-3000T, Shin-Etsu Chemical Co., Ltd.): 7.5 parts Methyl styrene modified silicone (product name: X-24-510, Shin-Etsu Chemical Co., Ltd.): 7.5 parts Polyether modified silicone (product name: FZ2101, Nippon Unicar Company Limited): 5 parts Methyl ethyl ketone/Toluene (mass ratio 1/1): 400 parts On the dye receiving layer which was formed as described above, an ink which was prepared from vinyl chloride-vinyl acetate copolymer and urethane acrylate resin (ionized radiation curable resin) used for a relief forming layer in such a manner that solid content ratio of them will be 1/1, was coated, by a coater, in such a manner that the thickness on the dried state basis will be 0.1 to 5 g/m$^2$, and then dried at 80° C. to form an anchor layer. On the anchor layer, urethane acrylate resin (ionized radiation curable resin) was coated by a gravure reverse coater at film rate 50 m/min, in such a manner that the thickness on the dried state basis will be 0.5 to 1.0 g/m$^2$, and then dried at 100° C. to form a relief forming layer. Then, a process for patterning a relief by compressing (embossing) a stamper onto the relief forming layer, i.e. a hologram reproduction process was started. The stamper which was reproduced from a master hologram by 2P process was applied onto an emboss roller mounted on a reproduction apparatus. The relief forming layer was compressed (embossed) with heating between the emboss roller and a roller opposite to the emboss roller, so that a relief made of a fine corrugation-like pattern was formed on the relief forming layer. Immediately after patterning, the relief forming layer was irradiated with UV light to be cured. On a relief surface, aluminum was deposited by a vacuum vapor deposition to a thickness of 300 Å (angstrom) to form a reflection layer and thereby form a reflection type relief hologram. On the reflection layer of the relief surface, an adhesive layer coating liquid having the following composition was coated by a gravure coating and then dried at 100° C. to form an adhesive layer having a thickness of 0.5 g/m$^2$, so that a receiving layer transfer material of Example A1 was obtained.

<Adhesive Layer Coating Liquid>

Butyl methacrylate resin (A-415, Dainippon Ink and Chemicals, Incorporated): 30 parts Methyl ethyl ketone: 10 parts Toluene: 10 parts

Example A2

A receiving layer transfer material of Example A2 was made in a similar manner as Example A1, except that the anchor layer which was disposed between the dye receiving layer and the relief forming layer in the receiving layer transfer material of Example A1 was removed.

Example A3

A receiving layer transfer material of Example A3 was made in a similar manner as Example A1, except that zinc sulfide (ZnS) was deposited in a vacuum vapor deposition to a thickness of 300 Å as the reflection layer, instead of aluminum in the receiving layer transfer material of Example A1.

Example A4

A receiving layer transfer material of Example A4 was made in a similar manner as Example A1, except that titanium oxide ($TiO_2$) was deposited in a vacuum vapor deposition to a thickness of 300 Å as the reflection layer, instead of aluminum in the receiving layer transfer material of Example A1.

By using these receiving layer transfer material of Examples A1 to A4, each transfer layer which is a layered structure of adhesive layer/reflection layer/relief forming layer/anchor layer (optionally)/dye receiving layer was transferred in a pattern such as heart-print, by means of a thermal transfer printer of 600 dpi, onto a greeting card which is obtained by printing a design, picture and the like, by a known offset printing, onto a coated paper as object having a grammage of 300 g/m$^2$. Onto this transferred pattern, facial portrait and letters were printed by using a transfer sheet of Examples B series (Comparative Example B1), which will be discussed later, with a thermal transfer printer of 600 dpi, so that the facial portrait and letter image were formed with sharpness and high quality.

Example A5

A polyethylene terephthalate film (product name: lumirror, Toray Industries, Inc.) having a thickness of 6 μm was used as a substrate of a thermal transfer layer. A heat resistant smooth layer was formed on an entire rear surface of the substrate in a similar manner as Example A1.

Onto another surface (front surface), four regions including a transfer layer region, a Y region, a M region and a C region were formed, as shown in FIG. 4B. Each region was sized at 95 mm in a transfer sheet flow direction and 60 mm in a direction vertical to the flow direction, in order to beyond a general card size. These four regions were sequentially repeated.

In the transfer layer region, a release layer, a dye receiving layer, an anchor layer and a relief forming layer were formed by a gravure printing, by using the release layer coating liquid, the dye receiving layer coating liquid, the anchor layer coating liquid and the relief forming layer coating liquid, which were the same as Example A1.

Then, a process for patterning a relief by compressing (embossing) a stamper onto the relief forming layer, i.e. a hologram reproduction process was started. The stamper which was reproduced from a master hologram by 2P process was applied onto an emboss roller mounted on a reproduction apparatus. The relief forming layer was compressed (embossed) with heating between the emboss roller and a roller opposite to the emboss roller, so that a relief made of a fine corrugation-like pattern was formed on the relief forming layer. Immediately after patterning, the relief forming layer was irradiated with UV light to be cured.

On a relief surface, aluminum was deposited by a vacuum vapor deposition to a thickness of 300 Å to form a reflection layer and thereby form a reflection type relief hologram.

On the transfer layer region of the reflection layer of the relief surface, the adhesive layer coating liquid which was the same as Example A1 was coated by a gravure coating and then dried at 100° C. to form an adhesive layer having a thickness of 0.5 g/m$^2$.

Then, inks each including yellow, magenta or cyan dye respectively and having the following composition respectively were prepared by mixing for 6 hours by means of a paint shaker. These prepare inks were coated respectively onto the Y region, the M region and the C region, by a gravure printing in such a manner that the coating amount will be 0.8 g/m$^2$ on the dried state basis, and then dried to form a region containing the yellow dye (Y), a region containing the magenta (M) dye and a region containing the cyan (C) dye.

(Ink Containing Yellow (Y) Dye)

Disperse dye (yellow disperse dye: quinophthalone dye): 5.5 wt. parts

Acetoacetal resin (KS-5, Sekisui Chemical Co., Ltd.): 3.5 wt. parts

Polyethylene powder (MF8F, ASTORWAX Co.): 0.1 wt. parts

Toluene: 45 wt. parts

Methyl ethyl ketone: 45 wt. parts (Ink Containing Magenta (M) Dye)

The composition was the same as the yellow dye, except that magenta disperse dye (C.I. Disperse Red 60) of 5.5 wt. parts was used as the disperse dye.

(Ink Containing Cyan (C) Dye)

The composition was the same as the yellow dye, except that cyan disperse dye (C.I. Solvent Blue 63) of 5.5 wt. parts was used as the disperse dye.

Thus, the thermal transfer sheet was obtained which has a "transfer YMC region" in which one set of the transfer layer region, the Y region, the M region and the C region was repeatedly disposed.

Four sheets including an over sheet made of transparent vinyl chloride resin having a thickness of 100 μm, a card core made of white vinyl chloride having a thickness of 280 μm where a picture of a card design was printed by a known offset printing or screen printing, a card core made of white vinyl chloride resin having a thickness of 280 nm where a picture of a card rear design was printed by a known offset printing, and an over sheet made of transparent vinyl chloride having a thickness of 100 μm are superimposed one after another and pressed by a thermal press machine into an one body, and then cooled to obtain a card substrate. The obtained substrate was punched by a punching machine into a credit card size. The obtained card was used as the object.

Onto the card, the transfer layer was transferred in a rectangular pattern sized at 20 by 30 mm by using the thermal transfer sheet of Example A5 with a 1-head thermal transfer printer of 600 dpi. Then, onto the transferred pattern, a facial portrait and letters were printed, so that a color facial portrait and letter image was formed with sharpness and high quality.

Example A6

A thermal transfer image receiving sheet for sealing provided with: the receiving layer/seal substrate/adhesive layer (seal portion); and a release substrate with a release layer was used as the object. Firstly, coating liquids for forming each layer were prepared.

<Release Layer Coating Liquid>

Addition polymerization type silicone (KS847H, Shin-Etsu Chemical Co., Ltd.): 100 wt. parts Solvent (toluene): 200 wt. parts <Adhesive Layer Coating Liquid>

Acryl copolymer (SK-dyne 1310L, Soken Chemical & Engineering Co., Ltd.): 48 wt. parts Epoxy resin (curing agent AX, Soken Chemical & Engineering Co., Ltd.): 0.36 wt. parts Solvent (ethyl acetate): 51.64 wt. parts <Receiving Layer Coating Liquid>

Vinyl chloride-vinyl acetate copolymer (SOLBIN C, Nissin Chemical Industry Co., Ltd.): 40 wt. parts Polyester (VYLON 600, Toyobo Co., Ltd.): 40 wt. parts Vinyl chloride-styrene-acryl copolymer (Denkalac #400, Denki Kagaku Kogyo Kabushiki Kaisha): 20 wt. parts Vinyl modified silicone (X-62-1212, Shin-Etsu Chemical Co., Ltd.): 10 wt. parts Catalyst (CAT-PLR-5, Shin-Etsu Chemical Co., Ltd.): 5 wt. parts Solvent (methyl ethyl ketone: toluene=1:1): 400 wt. parts <Formation of Thermal Transfer Image Receiving Sheet for Sealing>

Firstly, on one surface of the release substrate having a thickness of 100 μm (polyethylene terephthalate film with surface corona treatment, Crisper G-1212, Toyobo Co., Ltd.), the release layer coating liquid having the above-listed composition was coated by a gravure printing and smoothed the coated surface before a drying hood and then dried to form a release layer in its coating amount 0.1 g/m$^2$. Then, onto a surface of the release layer, the adhesive layer coating liquid having the above-listed composition was coated by a gravure printing and dried to form an adhesive layer in its coating amount 10 g/m$^2$.

On the other hand, on one surface of the seal substrate having a thickness of 50 μm (polyethylene terephthalate film with inner voids, Lumirror E63 #50, Toray Industries Inc.), the receiving layer coating liquid having the above-listed composition was coated by a gravure printing and dried to form a receiving layer in its coating amount 4.5 g/m$^2$. Another surface of the seal substrate was laminated onto the adhesive layer surface of the release substrate at 100° C. for 12 seconds. Then, on a surface of the receiving layer, quaternary ammonium salt compound (1% solution of TB-34, Matsumoto Yushi-Seiyaku Co., Ltd.) as antistatic agent was coated and dried to obtain a thermal transfer image receiving sheet for sealing. This thermal transfer image receiving sheet for sealing was used as the object of Example A6.

The object was supplied to a printer (product name: S8045, Shinko Electric Co., Ltd.). Since the printer S8045 was a 2-head printer, the colorant layer of the transfer sheet of Examples B series (Comparative Example B1), which will be discussed later, was sized at 110 mm in a flow direction and 160 mm in a direction vertical to the flow direction, as well as the receiving layer transfer material of Example A1. Firstly, the receiving transfer material was thermally transferred into any shape (rectangle, various geometries, letters and so on) at the first thermal head. Then, at the second thermal head, a facial portrait or the like was printed from the transfer sheet on a part where the receiving transfer material was not transferred, while color was given from the transfer sheet on the pattern where the receiving layer transfer material was transferred. The highly designable print product was formed with sharpness and high quality.

Examples B Series

Example B1

Polyethylene terephthalate film having a thickness of 6 μm (product name: Lumirror, Toray Industries, Inc.) was used as a substrate of a receiving layer transfer material. Onto a rear surface of the substrate, a heat resistant smooth layer coating material having the following composition was coated by a gravure printing in such a manner that the coating amount will be 0.10 to 0.20 g/m$^2$ on the dried state basis, and then dried to form a heat resistant smooth layer.

<Heat Resistant Smooth Layer Coating Liquid>

Polyvinyl butyral resin (product name: S-LEC BX-1, Sekirui Chemical Co., Ltd.): 13.6 parts Polyisocyanate curing agent (product name: Takenate D218, Takeda Pharmaceutical Company Limited.): 0.6 parts Phosphoric ester (Plysurf A208S, Dai-Ichi Kogyo Seiyaku Co., LTD.): 0.8 parts Methyl ethyl ketone: 42.5 parts Toluene: 42.5 parts A release layer coating liquid having the following composition was coated on a surface of the substrate different from the surface where the heat resistant smooth layer was formed, by a coater, in such a manner that the thickness on the dried state basis will be 0.5 g/m$^2$, and then dried at 80° C. to form a release layer. In this specification, "part" or "parts" in the composition is based on weight, unless otherwise noted.

<Release Layer Coating Liquid>

Silicone modified acrylic resin (product name: CELTOP 226, Daicel Chemical Industry Co., Ltd.): 16 parts Aluminum catalyst (product name: CELTOP CAT-A, Daicel Chemical Industry Co., Ltd.): 3 parts Toluene/Methyl ethyl ketone (mass ratio 1/1): 16 parts Onto a surface of the release layer, a dye receiving layer coating liquid having the following composition was coated by a coater in such a manner that the thickness on the dried state basis will be 0.5~1.0 g/m$^2$ and dried at 80° C. to form a dye receiving layer.

<Dye Receiving Layer Coating Liquid>

Vinyl chloride-vinyl acetate copolymer (product name: SOLBIN C, Nissin Chemical Industry Co., Ltd.): 100 parts Epoxy modified silicone (X-22-3000T, Shin-Etsu Chemical Co., Ltd.): 7.5 parts Methyl styrene modified silicone (X-24-510, Shin-Etsu Chemical Co., Ltd.): 7.5 parts Polyether modified silicone (FZ2101, Nippon Unicar Company Limited): 5 parts Methyl ethyl ketone/Toluene (mass ratio 1/1): 400 parts On the dye receiving layer which was formed as described above, an ink which was prepared from vinyl chloride-vinyl acetate copolymer and urethane acrylate resin (ionized radiation curable resin) used for a relief forming layer in such a manner that solid content ratio of them will be 1/1, was coated, by a coater, in such a manner that the thickness on the dried state basis will be 0.1 to 5 g/m$^2$, and then dried at 80° C. to form an anchor layer. On the anchor layer, urethane acrylate resin (ionized radiation curable resin) was coated by a gravure reverse coater at film rate 50 m/min, in such a manner that the thickness on the dried state basis will be 0.5 to 1.0 g/m$^2$, and then dried at 100° C. to form a relief forming layer. Then, a process for patterning a relief by compressing (embossing) a stamper onto a surface of the relief forming layer, i.e. a hologram reproduction process was started. The stamper which was reproduced from a master hologram (having white reflector function) by 2P process was applied onto an emboss roller mounted on a reproduction apparatus. The relief forming layer was compressed (embossed) with heating between the emboss roller and a roller opposite to the emboss roller, so that a relief made of a fine corrugation-like pattern was formed on the relief forming layer. Immediately after patterning, the relief forming layer was irradiated with UV light to be cured.

On a relief surface, aluminum was deposited by a vacuum vapor deposition to a thickness of 300 Å (angstrom) to form a reflection layer and thereby form a reflection type relief hologram. On the reflection layer of the relief surface, an adhesive layer coating liquid having the following composition was coated by a gravure coating and then dried at 100° C. to form an adhesive layer having a thickness of 0.5 g/m$^2$, so that a receiving layer transfer material of Example A1 was obtained.

<Adhesive Layer Coating Liquid>

Butyl methacrylate resin (A-415, Dainippon Ink and Chemicals, Incorporated): 30 parts Methyl ethyl ketone: 10 parts Toluene: 10 parts Example B2

A receiving layer transfer material of Example B2 was made in a similar manner as Example B1, except that the anchor layer which was disposed between the dye receiving layer and the relief forming layer in the receiving layer transfer material of Example B1 was removed.

Example B3

A receiving layer transfer material of Example B3 was made in a similar manner as Example B1, except that chromium (Cr) was deposited in a vacuum vapor deposition to a thickness of 300 Å as the reflection layer, instead of aluminum in the receiving layer transfer material of Example B1.

Example B4

A receiving layer transfer material of Example B4 was made in a similar manner as Example B1, except that nickel (Ni) was deposited in a vacuum vapor deposition to a thickness of 300 Å as the reflection layer, instead of aluminum in the receiving layer transfer material of Example B1.

Example B5

A polyethylene terephthalate film (product name: lumirror, Toray Industries, Inc.) having a thickness of 6 μm was used as a substrate of a thermal transfer layer. A heat resistant smooth layer was formed on an entire rear surface of the substrate in a similar manner as Example B1.

Onto another surface (front surface), four regions including a transfer layer region, a Y region, a M region and a C region were formed, as shown in FIG. 4B. Each region was sized at 95 mm in a transfer sheet flow direction and 60 mm in a direction vertical to the flow direction, in order to beyond a general card size. These four regions were sequentially repeated.

In the transfer layer region, a release layer, a dye receiving layer, an anchor layer and a relief forming layer were sequentially formed by a gravure printing, by using the release layer coating liquid, the dye receiving layer coating liquid, the anchor layer coating liquid and the relief forming layer coating liquid, which were the same as Example B1.

Then, a process for patterning a relief by compressing (embossing) a stamper onto a surface of the relief forming layer, i.e. a hologram reproduction process was started. The stamper which was reproduced from a master hologram (having white reflector function) by 2P process was applied onto an emboss roller mounted on a reproduction apparatus. The relief forming layer was compressed (embossed) with heating between the emboss roller and a roller opposite to the emboss roller, so that a relief made of a fine corrugation-like pattern was formed on the relief forming layer. Immediately after patterning, the relief forming layer was irradiated with UV light to be cured.

On a relief surface, aluminum was deposited by a vacuum vapor deposition to a thickness of 300 Å to form a reflection layer and thereby form a reflection type relief hologram.

On the transfer layer region of the reflection layer of the relief surface, the adhesive layer coating liquid which was the same as Example B1 was coated by a gravure coating and then dried at 100° C. to form an adhesive layer having a thickness of 0.5 g/m$^2$.

Then, inks each including yellow, magenta or cyan dye respectively and having the following composition respectively were prepared by mixing for 6 hours by means of a paint shaker. These prepare inks were coated respectively onto the Y region, the M region and the C region, by a gravure printing in such a manner that the coating amount will be 0.8 g/m$^2$ on the dried state basis, and then dried to form a region containing the yellow dye (Y), a region containing the magenta (M) dye and a region containing the cyan (C) dye.

(Ink Containing Yellow (Y) Dye)

Disperse dye (yellow disperse dye: quinophthalone dye): 5.5 wt. parts

Acetoacetal resin (KS-5, Sekisui Chemical Co., Ltd.): 3.5 wt. parts

Polyethylene powder (MF8F, ASTORWAX Co.): 0.1 wt. parts

Toluene: 45 wt. parts

Methyl ethyl ketone: 45 wt. parts (Ink Containing Magenta (M) Dye)

The composition was the same as the yellow dye, except that magenta disperse dye (C.I. Disperse Red 60) of 5.5 wt. parts was used as the disperse dye.

(Ink Containing Cyan (C) Dye)

The composition was the same as the yellow dye, except that cyan disperse dye (C.I. Solvent Blue 63) of 5.5 wt. parts was used as the disperse dye.

Thus, the thermal transfer sheet was obtained which has a "transfer YMC region" in which one set of the transfer layer region, the Y region, the M region and the C region was repeatedly disposed.

Example B6

Instead of the Y region, the M region and the C region of Example B5, an R region, a G region, a B region and a K region were formed by using inks each having the following composition respectively, in a similar manner as Example B5.

(Ink Containing Red (R) Dye)

Quinophthalone dye: 2.25 wt. parts

C.I. Disperse Red 60: 2.25 wt. parts

Acetoacetal resin (KS-5, Sekisui Chemical Co.,: 3.5 wt. parts

Polyethylene power (MF8F, ASTORWAX Co.): 0.1 wt. parts

Toluene: 45 wt. parts

Methyl ethyl ketone: 45 wt. parts (Ink Containing Green (G) Dye)

Quinophthalone dye: 2.25 wt. parts

C.I. Solvent Blue 63: 2.25 wt. parts

Acetoacetal resin (KS-5, Sekisui Chemical Co., Ltd.): 3.5 wt. parts

Polyethylene powder (MF8F, ASTORWAX Co.): 0.1 wt. parts

Toluene: 45 wt. parts

Methyl ethyl ketone: 45 wt. parts (Ink Containing Blue (B) Dye)

Cyan disperse dye (C.I. Solvent Blue 63): 5.5 wt. parts

Acetoacetal resin (Sekisui Chemical Co., Ltd.): 3.5 wt. parts

Polyethylene powder (MF8F, ASTORWAX Co.): 0.1 wt. parts

Toluene: 45 wt. parts

Methyl ethyl ketone: 45 wt. parts (Ink Containing Black (K) Dye)

Yellow disperse dye (quinophthalone dye): 1.8 wt. parts

Magenta disperse dye (C.I. Disperse Red 60): 1.8 wt. parts

Cyan disperse dye (C.I. Solvent Blue 63): 1.8 wt. parts

Acetoacetal resin (KS-5, Sekisui Chemical Co., Ltd.): 3.5 wt. parts

Polyethylene powder (MF8F, ASTORWAX Co.): 0.1 wt. parts

Toluene: 45 wt. parts

Methyl ethyl ketone: 45 wt. parts

Thereby, the thermal transfer sheet was obtained which has a "transfer RGBK region" in which one set of five regions including the transfer layer region, the R region, the G region, the B region and the K region were repeatedly disposed.

Comparative Example B1

A transfer sheet having a "YMC region" of Comparative Example B1 was made in a similar manner as Example B5, except that the transfer layer was removed in the transfer sheet of Example B5.

Comparative Example B2

A transfer sheet having an "RGBK region" of Comparative Example B2 was made in a similar manner as Example B6, except that the transfer layer was removed in the transfer sheet of Example B6.

Example B7

By using these receiving layer transfer material of Examples B1 to B4, each transfer layer which is a layered structure of adhesive layer/reflection layer/relief forming layer/anchor layer (optionally)/dye receiving layer was transferred in a pattern such as heart-print, by means of a thermal transfer printer of 600 dpi, onto a greeting card which is obtained by printing a design, picture and the like, by a known offset printing, onto a coated paper as object having a grammage of 300 g/m$^2$. Onto this transferred pattern, facial portrait and letters were printed by using a transfer sheet of the Comparative Example B1, with a thermal transfer printer of 600 dpi, so that the facial portrait and letter image were formed with sharpness and high quality.

Example B8

Four sheets including an over sheet made of transparent vinyl chloride resin having a thickness of 100 μm and a magnetic stripe in a predetermined place, a card core made of white vinyl chloride resin having a thickness of 280 μm where a picture of a card design was printed by a known offset printing or screen printing, a card core made of white vinyl chloride resin having a thickness of 280 nm where a picture of a card rear design was printed by a known offset printing, and an over sheet made of transparent vinyl chloride having a thickness of 100 μm are superimposed one after another and pressed by a thermal press machine into an one body, and then cooled to obtain a card substrate. The obtained substrate was punched by a punching machine into a credit card size. The obtained card was used as the object.

In the thermal transfer card printer of 600 dpi, the receiving layer transfer materials of Examples B1 to B4 were loaded at the first head, and the transfer sheets of Comparative Examples 1 to 2 were loaded at the second head. Onto the card as the object, the transfer layer was transferred in a rectangular pattern sized at 20 by 30 mm. Then, onto the transferred pattern, a facial portrait and letters were printed. In any combination of receiving layer transfer material of Examples B1 to B4 and transfer sheets of Comparative Examples B1 to B2, a color facial portrait and letter image were formed with sharpness and high quality.

Example B9

The card used in Example B8 was used as the object. In the 1-head thermal transfer printer of 600 dpi, the transfer sheets of Examples B5 to B6 were loaded. Onto an entire surface of the card, the transfer layer was transferred. Then, onto the transfer layer, a facial portrait and letters were printed. A color facial portrait and letter image were formed with sharpness and high quality.

Example B10

Onto PET film having a thickness of 188 μm, an ink which was prepared from vinyl chloride-vinyl acetate copolymer and urethane acrylate resin (ionized radiation curable resin) used for a relief forming layer in such a manner that solid content ratio of them will be 1/1, was coated, by a coater, in such a manner that the thickness on the dried state basis will be 0.1 to 5 g/m$^2$, and then dried at 80° C. to form an anchor layer. Onto the anchor layer, urethane acrylate resin (ionized radiation curable resin) was coated by a gravure reverse coater at film rate 50 m/min, in such a manner that the thickness on the dried state basis will be 0.5 to 1.0 g/m$^2$, and then dried at 100° C. to form a relief forming layer. Then, a process for patterning a relief by compressing (embossing) a stamper onto a surface of the relief forming layer, i.e. a hologram reproduction process was started. The stamper which was reproduced from a master hologram (having white reflector function) by 2P process was applied onto an emboss roller mounted on a reproduction apparatus. The relief forming layer was compressed (embossed) with heating between the emboss roller and a roller opposite to the emboss roller, so that a relief made of a fine corrugation-like pattern was formed on the relief forming layer. Immediately after patterning, the relief forming layer was irradiated with UV light to be cured.

On a relief surface, aluminum was deposited by a vacuum vapor deposition to a thickness of 300 Å (angstrom) to form a reflection layer and thereby form a reflection type relief hologram (having white reflector function).

Onto a surface of the reflection layer, a dye receiving layer coating liquid having the following composition was coated, by a coater, in such a manner that the thickness on the dried state basis will be 0.5 to 1.0 g/m$^2$, and then dried at 80° C. to form a dye receiving layer.

<Dye Receiving Layer Coating Liquid>

Vinyl chloride-vinyl acetate copolymer (product name: SOLBIN C, Nissin Chemical Industry Co., Ltd.): 100 parts Epoxy modified silicone (product name: X-22-3000T, Shin-Etsu Chemical Co., Ltd.): 7.5 parts Methyl styrene modified silicone (product name: X-24-510, Shin-Etsu Chemical Co., Ltd.): 7.5 parts Polyether modified silicone (product name: FZ2101, Nippon Unicar Company Limited): 5 parts Solvent (MEK/Toluene=1/1): 400 parts As described above, the object having white reflection and the dye receiving layer was obtained.

In the 1-head thermal transfer printer of 600 dpi, the transfer sheets of Comparative Examples B1 to B2 were loaded. Onto an entire surface of the dye receiving layer of the object, the transfer layer was transferred. Then, onto the transferred pattern, a facial portrait and letters were printed, so that a greeting card with a color facial portrait and letter image was obtained with sharpness and high quality.

Example B11

The object was obtained in a similar manner as Example B10, except that polyester resin for ink jet receiving layer (NS-122LX, Takamatsu Oil & Fat Co., Ltd.) was coated by a coater in such a manner that the thickness on the dried state basis will be 0.5 to 1.0 g/m$^2$, and dried at 80° C. to form an ink jet image receiving layer, instead of the dye receiving layer.

Onto a surface of the image receiving layer of the object, a facial portrait and letters were printed by means of an ink jet printer of 400 dpi (Canon Inc.). A greeting card with a color facial portrait and letter image was obtained with sharpness and high quality.

Example B12

A thermal transfer image receiving sheet for sealing provided with a layer structure of receiving layer/seal substrate/adhesive layer (seal portion), and a release substrate with a release layer was used as the object. Firstly, coating liquids for forming each layer were prepared.

<Release Layer Coating Liquid>

Additionally polymerization type silicone (KS847H, Shin-Etsu Chemical Co., Ltd.): 100 wt. parts Solvent (toluene): 200 wt. parts <Adhesive Layer Coating Liquid>

Acryl copolymer (SK-Dyne 1310L, Soken Chemical & Engineering Co., Ltd.): 48 wt. parts Epoxy resin (Curing agent-AX, Soken Chemical & Engineering Co., Ltd.): 0.36 wt. parts Solvent (ethyl acetate): 51.64 wt. parts <Receiving Layer Coating Liquid>

Vinyl chloride-vinyl acetate copolymer (SOLBIN C, Nissin Chemical Industry Co., Ltd.): 40 wt. parts Polyester (VYLN 600, Toyobo Co., Ltd.): 40 wt. parts Vinyl chloride-styrene-acryl copolymer (Denkalac #400, Denki Kagaku Kogyo Kabushiki Kaisha): 20 wt. parts Vinyl modified silicone (X-62-1212, Shin-Etsu Chemical Co., Ltd.): 10 wt. parts Catalyst (CAT-PLR-5, Shin-Etsu Chemical Co., Ltd.): 5 wt. parts Solvent (methyl ethyl ketone: toluene=1:1): 400 wt. parts <Formation of Thermal Transfer Image Receiving Sheet for Sealing>

Firstly, onto one surface of a release substrate having a thickness of 100 μm (surface corona treated polyethylene terephthalate film, Crisper G-1212, Toyobo Co., Ltd.), the release layer coating liquid having the above listed composition was coated by a gravure coating and smoothed before a dry hood, and then dried to form a release layer in its coating amount of 0.1 g/m$^2$ on the dried state basis. Then, onto a surface of the release layer, the adhesive layer coating liquid having the above listed composition was coated by a gravure coating and dried to form an adhesive layer in its coating amount of 10 g/m$^2$ on the dried state basis.

On the other hand, on one surface of the seal substrate having a thickness of 50 μm (polyethylene terephthalate film with inside voids, Lumirror E63#50, Toray Industries, Inc.), the receiving layer coating liquid having the above listed composition was coated by a gravure coating and dried to form a receiving layer in its coating amount 4.5 g/m$^2$ on the dried state basis. Another surface of the seal substrate was laminated on the adhesive layer surface of the release substrate at 100° C. for 12 seconds. Then, onto a surface of the receiving layer, a quaternary ammonium salt compound (1% solution of TB-34, Matsumoto Yushi-Seiyaku Co., Ltd.) as an antistatic agent was coated and dried to obtain a thermal transfer image receiving sheet for sealing. This thermal transfer image receiving sheet for sealing was used as the object of Example B12.

Onto a surface of the dye receiving layer of the object obtained as such, paper was fed to a printer (S8045, Shinko Electric Co., Ltd.). Although the printer S8045 was a 2-head printer, only 1-head was used to print. The transfer sheet of Example B5 or B6 was used. The transfer layer region and each colorant layer size were sized at 110 mm in a transfer sheet flow direction and 160 mm in a direction vertical to the flow direction. The transfer sheet of Example B5 or B6 was loaded to the printer and transferred on an entire surface. Then, onto the transferred pattern, a facial portrait and letters were printed. A color facial portrait and letter image were formed with sharpness and high quality.

Example B13

In a 2-head thermal transfer card printer of 600 dpi (S8045, Shinko Electric Co., Ltd.), the receiving layer transfer materials of Examples B1 to B4 were loaded at the first heat portion, and the transfer sheets of Comparative Example B1 to B2 (transfer layer region and each colorant layer were sized at 110 mm in a transfer sheet flow direction and 160 mm in a direction vertical to the flow direction) were loaded at the second head portion. Onto the image receiving paper of Example B12 (thermal transfer image receiving sheet for sealing) as the object, the transfer layer was transferred in a rectangular pattern of 20 by 30 mm. Then, onto the transferred pattern, a facial portrait and letters were printed. In any combination of receiving layer transfer material of Examples B1 to B4 and transfer sheets of Comparative Examples B1 to B2, a color facial portrait and letter image were formed with sharpness and high quality.

Furthermore, by using only the second head portion, a facial portrait and letters were printed with the transfer sheets of Comparative Examples B1 to B2. A conventional color facial portrait and letter image were formed.

Therefore, both the image according to the present invention and the conventional image can be printed out by the same printer.

The invention claimed is:

1. A colorant receiving sheet with a relief layer, comprising:

a substrate;

a relief forming layer having a relief forming surface having a relief pattern which exhibits white light within a specific angle range and a reflection layer disposed on the relief forming side at a, formed on one surface of the substrate; and a colorant receiving layer, formed above the relief forming layer or at a side of the substrate opposite to the side of the substrate having the relief forming layer, wherein the relief pattern is CGH (Computer Generated Hologram), which diffuses incident light into a predetermined angle range when the incident light having a predetermined standard wavelength is incident on the CGH with a predetermined incident angle, and is designed so that a maximum diffraction angle of the incident light with the incident angle at the shortest wavelength is greater than a minimum diffraction angle of the incident light with the incident angle at a longest wavelength, wherein the shortest wavelength and the longest wavelength define a wavelength range which includes the standard wavelength and enables zero order transmitted light or zero order reflected light of the incident light with the incident angle to be observed as white color when performing additive color mixing.

2. The colorant receiving sheet with the relief layer according to claim 1, wherein at least;

the relief forming layer having the reflection layer at the relief forming side and having the visual effect; and the colorant receiving layer, are sequentially stacked on one surface of the substrate.

3. The colorant receiving sheet with the relief forming layer according to claim 2, wherein at least;

the reflection layer;

the relief forming layer; and the colorant receiving layer, are sequentially stacked on one surface of the substrate.

4. The colorant receiving sheet with the relief forming layer according to claim 1, wherein the colorant receiving layer comprises a thermoplastic resin and a release agent.

5. An image forming method comprising the step of:

forming an image comprising a colorant by an on-demand printing, onto the colorant receiving sheet with the relief layer according to claim 1, and the method forms an image comprising both white light from a relief forming layer and the image comprising the colorant.

6. An image-formed object formed by the image forming method according to claim 5, wherein the object comprises the image both comprising white light from the relief forming layer and the image comprising the colorant.

* * * * *